US010287145B2

(12) United States Patent
Iwazawa

(10) Patent No.: US 10,287,145 B2
(45) Date of Patent: May 14, 2019

(54) MOBILE CRANE

(71) Applicant: KOBELCO CONSTRUCTION MACHINERY CO., LTD., Hiroshima-shi (JP)

(72) Inventor: Takahiro Iwazawa, Hyogo (JP)

(73) Assignee: KOBELCO CONSTRUCTION MECHINERY CO., LTD., Hiroshima-shi (JP)

( * ) Notice: Subject to any disclaimer, the term of this patent is extended or adjusted under 35 U.S.C. 154(b) by 493 days.

(21) Appl. No.: 15/212,619

(22) Filed: Jul. 18, 2016

(65) Prior Publication Data

US 2017/0022034 A1 Jan. 26, 2017

(30) Foreign Application Priority Data

Jul. 23, 2015 (JP) ..... 2015-145698

(51) Int. Cl.
*B66C 13/20* (2006.01)
*B66C 23/74* (2006.01)

(52) U.S. Cl.
CPC ..... *B66C 23/74* (2013.01); *B66C 13/20* (2013.01)

(58) Field of Classification Search
CPC ..... B66C 23/76; B66C 13/20
See application file for complete search history.

(56) References Cited

U.S. PATENT DOCUMENTS

2014/0283507 A1* 9/2014 Kisselbach ..... F15B 21/082 60/327

FOREIGN PATENT DOCUMENTS

JP 5-208796 8/1993
JP 2002005109 A * 1/2002

OTHER PUBLICATIONS

Machine Translation of JPH-05208796 Best Prior Art of Record (see Applicant's IDS). (Year: 1993).*
Machine Translation of JP-2002005109 (Year: 2002).*

* cited by examiner

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

A mobile crane includes a crane main body including a control valve which controls a supply flow rate of hydraulic oil to a main-body driving motor and a pilot-pressure control device which controls a pilot pressure supplied to the control valve. The pilot-pressure control device increases the pilot pressure at a first ratio according to an increase in an operation amount of an operation section when a counterweight carrier is an uncoupled state, increases the pilot pressure at a second ratio lower than the first ratio according to the increase in the operation amount when the counterweight carrier is a coupled state and a grounded state, and increases the pilot pressure at a third ratio higher than the second ratio and equal to or lower than the first ratio according to the increase in the operation amount when the counterweight carrier is the coupled state and an afloat state.

3 Claims, 10 Drawing Sheets

MOBILE CRANE

TECHNICAL FIELD

The present invention relates to a mobile crane.

BACKGROUND ART

There has been known a mobile crane including a travelable crane main body and a counterweight carrier capable of traveling together with the crane main body. The counterweight carrier is mounted with a counterweight to increase stability of the crane main body and improve a hoisting ability of the crane. Japanese Unexamined Patent Publication No. H5-208796 discloses an example of the mobile crane including such a counterweight carrier.

The crane disclosed in Japanese Unexamined Patent Publication No. H5-208796 includes a crane main body including a lower traveling body and an upper swing body and a counterweight carrier coupled to a rear portion of the upper swing body via a coupling member.

The lower traveling body includes a main body traveling motor. The lower traveling body is capable of self-traveling with power generated by the main body traveling motor. The upper swing body is mounted on the lower traveling body to be capable of swing around a vertical axis. In the upper swing body, a work device for hoisting work including a boom, a boom guyline, a mast, a carrier guyline, and a hoisting accessory is provided. The crane main body includes a main body swing motor for driving to swing the upper swing body. When the upper swing body swings during the hoisting work or the like, the upper swing body is caused to swing by the power generated by the main body swing motor.

The counterweight carrier is connected to the mast of the work device via the carrier guyline to share a hoisting load applied to the work device. The counterweight carrier includes a plurality of wheels and a carrier traveling motor. The carrier traveling motor rotates the wheels, whereby the counterweight carrier is capable of self-traveling. The wheels are capable of being steered around a vertical axis. During the traveling of the crane main body by the lower traveling body, the carrier traveling motor rotates the wheels in a state in which the wheels are steered such that the orientation of the wheels coincides with the front-back direction of the lower traveling body, whereby the counterweight carrier travels in a direction same as a traveling direction of the crane main body. During the swing of the upper swing body, the carrier traveling motor rotates the wheels in a state in which the wheels are steered such that the orientation of the wheels is along a swing direction of the upper swing body, whereby the counterweight carrier travels in a direction same as the swing direction of the upper swing body.

In the mobile crane explained above, for operation of the mobile crane (the swing of the upper swing body and the traveling of the crane main body by the lower traveling body), the power of the carrier traveling motor can be used in some case and cannot be used in other cases.

For example, in some case, the counterweight carrier receives a hoisting load from the work device for hoisting work and is afloat above the ground. In this case, even if the carrier traveling motor rotates the wheels, since the wheels are not grounded, the power of the carrier traveling motor cannot be used for the swing of the upper swing body and the traveling of the crane main body. On the other hand, in a state in which the wheels of the counterweight carrier are grounded, the power of the carrier traveling motor can be used for the swing of the upper swing body and the traveling of the crane main body.

In the mobile crane, the counterweight carrier is not always coupled to the upper swing body. That is, in some case, the counterweight carrier is detached from the upper swing body and the crane main body independently operates. In this case, the power of the carrier traveling motor cannot be used for the operation of the crane main body.

As explained above, the power of the carrier traveling motor can be used or cannot be used for the operation of the crane main body according to presence or absence of the coupling of the counterweight carrier to the upper swing body and presence or absence of the grounding of the counterweight carrier in a state in which the counterweight carrier is coupled to the upper swing body. When the power of the carrier traveling motor cannot be used, the crane main body needs to operate with only the power of the driving motor (the main body traveling motor or the main body swing motor) of the crane main body. It is likely that operation speed of the crane main body is deteriorated. On the other hand, when the power of the carrier traveling motor can be used, since the power of the carrier traveling motor is added to the power of the driving motor of the crane main body, it is likely that excessive power is obtained.

SUMMARY OF INVENTION

An object of the present invention is to provide a mobile crane capable of supplying power appropriate for operation of a crane main body according to presence or absence of coupling of a counterweight carrier to an upper swing body and presence or absence of grounding of the counterweight carrier in a state in which the counterweight carrier is coupled to the upper swing body.

A mobile crane according to an aspect of the present invention includes: a crane main body including a lower traveling body capable of self-traveling and an upper swing body mounted on the lower traveling body to be capable of swing around a vertical axis, the upper swing body including a work device adapted to perform hoisting work; a counterweight carrier configured to be capable of being switched to a coupled state in which the counterweight carrier is coupled to the upper swing body and an uncoupled state in which the counterweight carrier is disconnected from the upper swing body, in the coupled state, the counterweight carrier being movable according to a movement of the crane main body in a state in which a counterweight is mounted on the counterweight carrier and being capable of taking a grounded state and an afloat state, the grounded state being a state in which the counterweight carrier is in contact with a ground, the afloat state being a state in which the counterweight carrier is afloat above the ground with a load transmitted from the work device; a coupled-state deriving section configured to derive a state taken by the counterweight carrier out of the coupled state and the uncoupled state; and an afloat-state detecting section configured to detect a state taken by the counterweight carrier out of the grounded state and the afloat state, wherein the crane main body includes: an operation section configured to be operated to instruct an operation of the crane main body; a hydraulic pump configured to discharge hydraulic oil; a main-body driving motor configured to generate power for causing the crane main body to operate by being supplied with the hydraulic oil discharged from the hydraulic pump; a control valve provided in a supply route of the hydraulic oil between the hydraulic pump and the main-body driving motor and configured to control a supply flow rate of the hydraulic oil such that the supply flow rate of the hydraulic oil to the main-body driving motor increases as a pilot pressure supplied to the control valve increases; a pilot pressure source configured to supply the pilot pressure to the control valve; and a pilot-pressure control device configured to control the pilot pressure supplied from the pilot pressure source to the control valve, the counterweight carrier includes a carrier driving motor configured to generate power for moving the counterweight carrier according to a movement of the crane main body, and the pilot-pressure control device is configured to increase the pilot pressure supplied to the control valve at a first ratio according to an increase in an operation amount of the operation section when the state derived by the coupled-state deriving section is the uncoupled state, increase the pilot pressure supplied to the control valve at a second ratio lower than the first ratio according to the increase in the operation amount of the operation section when the state derived by the coupled-state deriving section is the coupled state and the state detected by the afloat-state detecting section is the grounded state, and increase the pilot pressure supplied to the control valve at a third ratio higher than the second ratio and equal to or lower than the first ratio according to the increase in the operation amount of the operation section when the state derived by the coupled-state deriving section is the coupled state and the state detected by the afloat-state detecting section is the afloat state.

DESCRIPTION OF EMBODIMENTS

A mobile crane 2 according to an embodiment of the present invention is explained with reference to FIGS. 1 to 9. Note that, in the following explanation, the mobile crane 2 is simply referred to as crane 2.

Figure 1:
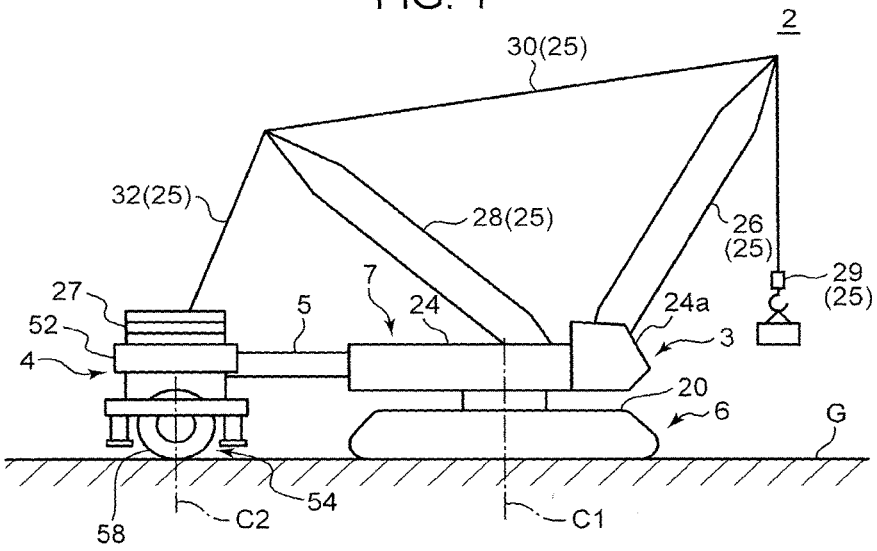
FIG. 1 is a schematic side view of a mobile crane according to an embodiment of the present invention and is a diagram showing a state in which a counterweight carrier is in a coupled state and a grounded state.

The crane 2 according to this embodiment includes, as shown in FIG. 1, a crane main body 3 configured to be capable of self-traveling and perform crane work, a counterweight carrier 4 for increasing stability of the crane main body 3 to improve a hoisting ability, and a coupling beam 5 that alternately couples the crane main body 3 and the counterweight carrier 4. In the following explanation, the counterweight carrier 4 is simply referred to as carrier 4. The crane 2 according to this embodiment is configured to take a coupled state (see FIGS. 1 and 2) and an uncoupled state (see FIG. 3). The coupled state of the crane 2 is a state in which the carrier 4 is coupled to an upper swing body 7 (explained below) of the crane main body 3 via the coupling beam 5. The uncoupled state of the crane 2 is a state in which the carrier 4 is disconnected from the upper swing body 7 and the crane main body 3 stands alone.

The crane main body 3 includes a lower traveling body 6, the upper swing body 7, a swing-body driving device 8 (see FIG. 5), a traveling operation device 9, a swing operation device 10, an engine 12, a number-of-revolutions detecting section 13, a hydraulic pump 14 (see FIG. 6), and a discharge-flow-rate changing device 15.

The lower traveling body 6 (see FIG. 1) is a crawler type and is configured to be capable of self-traveling. The lower traveling body 6 includes a pair of crawler devices 20 disposed to be separated into both side portions (left and right both side portions) in a vehicle width direction of the lower traveling body 6. The crawler devices 20 include not-shown driving devices including not-shown hydraulic motors, not-shown control valves, and not-shown switching valves. The configuration of the driving devices is the same as the configuration of the swing-body driving device 8 explained below. The hydraulic motors generate power by being supplied hydraulic oil to the hydraulic motors of the crawler devices 20. Whereby the crawler devices 20 operate to cause the lower traveling body 6 to self-travel.

The engine 12 (see FIG. 5), the number-of-revolutions detecting section 13 (see FIG. 5), the hydraulic pump 14 (see FIG. 6), and the discharge-flow-rate changing device 15 (see FIG. 6) are mounted on the lower traveling body 6.

The engine 12 supplies power to the hydraulic pump 14 so as to cause the hydraulic pump 14 to operate. The number-of-revolutions detecting section 13 is configured to detect the number of revolutions of the engine 12. The number-of-revolutions detecting section 13 is annexed to the engine 12. The number-of-revolutions detecting section 13 transmits data of the detected number of revolutions to a main-body-side controller 82 explained below.

The hydraulic pump 14 discharges hydraulic oil supplied to the hydraulic motors of the crawler devices 20, a swing motor 36 of the swing-body driving device 8, a steering motor of a steering device 55 of the carrier 4, and a wheel driving motor 62 of the carrier 4. The power is supplied from the engine 12 to the hydraulic pump 14, whereby the hydraulic pump 14 operates to discharge the hydraulic oil.

The hydraulic pump 14 is a variable displacement pump capable of changing a discharge flow rate of the hydraulic oil discharged by the hydraulic pump 14. Specifically, the hydraulic pump 14 includes a swash plate 14*a* (see FIG. 6), a tilt angle of which can be changed. The tilt angle of the swash plate 14*a* changes, whereby the displacement of the hydraulic pump 14 changes so that a flow rate of the hydraulic oil discharged by the hydraulic pump 14 changes.

Specifically, the discharge flow rate of the hydraulic oil of the hydraulic pump 14 increases as the tilt angle of the swash plate 14*a* increases.

The discharge-flow-rate changing device 15 changes the tilt angle of the swash plate 14*a* to thereby cause the hydraulic pump 14 to change a discharge flow rate of the hydraulic oil. The discharge-flow-rate changing device 15 includes a tilt-angle adjusting mechanism 15*a* and a tilt-angle-adjustment proportional valve 15*b*.

The tilt-angle adjusting mechanism 15*a* is connected to the swash plate 14*a* of the hydraulic pump 14. The tilt-angle adjusting mechanism 15*a* is a mechanism for changing the tilt angle of the swash plate 14*a*. The tilt-angle adjusting mechanism 15*a* adjusts the tilt angle of the swash plate 14*a* according to the magnitude of a supplied hydraulic pressure. Specifically, the tilt-angle adjusting mechanism 15*a* reduces the tilt angle of the swash plate 14*a* according to an increase in the supplied hydraulic pressure.

The tilt-angle-adjustment proportional valve 15*b* is a proportional solenoid valve that adjusts a hydraulic pressure supplied to the tilt-angle adjusting mechanism 15*a* in order to cause the tilt-angle adjusting mechanism 15*a* to adjust the tilt angle of the swash plate 14*a* of the hydraulic pump 14. The tilt-angle-adjustment proportional valve 15*b* is provided in a supply route for a hydraulic pressure between the tilt-angle adjusting mechanism 15*a* and a hydraulic pressure source 22. An electric current is input to the tilt-angle-adjustment proportional valve 15*b* from the main-body-side controller 82 (explained below). The tilt-angle-adjustment proportional valve 15*b* sets the magnitude of the hydraulic pressure supplied from the hydraulic pressure source 22 to the tilt-angle adjusting mechanism 15*a* to magnitude corresponding to the magnitude of the electric current input to the tilt-angle-adjustment proportional valve 15*b*. Specifically, the tilt-angle-adjustment proportional valve 15*b* increases the hydraulic pressure supplied to the tilt-angle adjusting mechanism 15*a* as the electric current input from the main-body-side controller 82 (explained below) increases. The tilt-angle adjusting mechanism 15*a* reduces the tilt angle of the swash plate 14*a* to reduce the discharge flow rate of the hydraulic oil of the hydraulic pump 14 according to the increase in the supplied hydraulic pressure. The value of the electric current input to the tilt-angle-adjustment proportional valve 15*b* and the discharge flow rate of the hydraulic oil of the hydraulic pump 14 are in a linear proportional relation.

Figure 2:
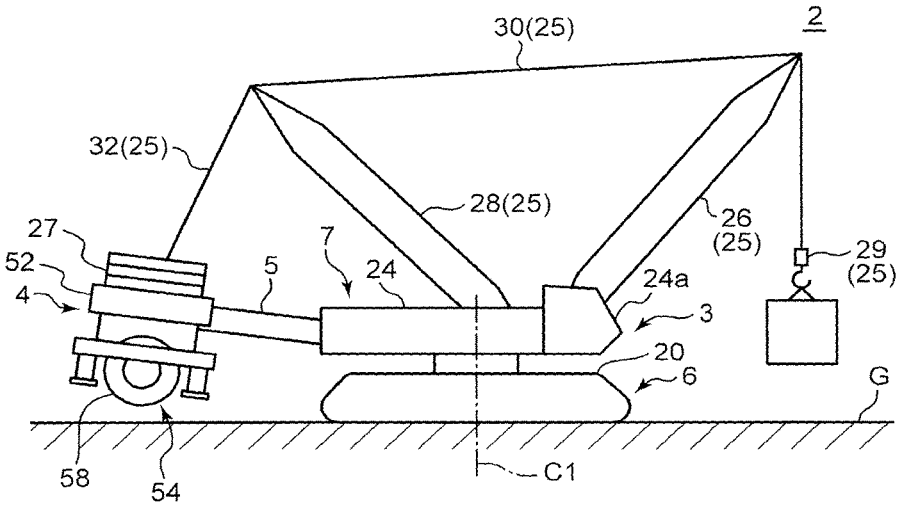
FIG. 2 is a schematic side view of the mobile crane according to the embodiment of the present invention and is a diagram showing a state in which the counterweight carrier is in the coupled state and an afloat state.
Figure 3:
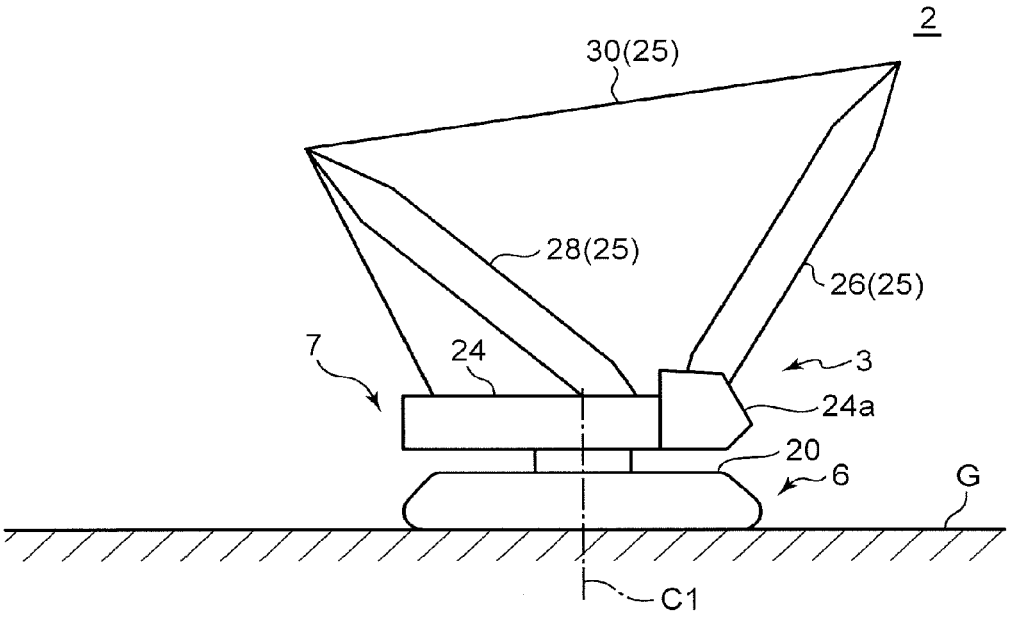
FIG. 3 is a schematic side view of the mobile crane according to the embodiment of the present invention and is a diagram showing a state in which the counterweight carrier is in an uncoupled state.

The upper swing body 7 (see FIG. 1) is mounted on the lower traveling body 6 to be capable of swing around a vertical axis C1. The upper swing body 7 includes, as shown in FIGS. 1 to 3, an upper swing body main body 24 attached on the lower traveling body 6 to be capable of swing and a work device 25 mounted on the upper swing body main body 24.

The work device 25 is a device for performing hoisting work of a cargo to be hoisted. The work device 25 includes a boom 26, a mast 28, a hoisting accessory 29, a boom guyline 30, and a carrier guyline 32.

The boom 26 is attached to a front end portion of the upper swing body main body 24 to be capable of rising and falling. The hoisting accessory 29 is suspended from the distal end portion of the boom 26 via a wire rope as shown in FIG. 2. A hoisting cargo is hoisted by the hoisting accessory 29.

The mast 28 is attached to the upper swing body main body 24 to be capable of swing around a horizontal axis with the proximal end portion (the lower end portion) of the boom 26 as a fulcrum in a position on the rear side of the boom 26. The distal end portion (the upper end portion) of the mast 28 is connected to the distal end portion of the boom 26 via the boom guyline 30. Consequently, the mast 28 supports the boom 26 in an erected state from the back via the boom guyline 30. The distal end portion of the mast 28 is connected to the carrier 4 via the carrier guyline 32.

Note that the "front side" concerning the upper swing body 7, the carrier 4, and the coupling beam 5 means a side where the boom 26 of the upper swing body 7 is provided. The "rear side" concerning the upper swing body 7, the carrier 4, and the coupling beam 5 means the opposite side of the side where the boom 26 is provided. The "right side" concerning the upper swing body 7, the carrier 4, and the coupling beam 5 means a right side at the time when the upper swing body 7, the carrier 4, and the coupling beam 5 are viewed from the rear side toward the front side thereof in a state in which the upper swing body 7, the carrier 4, and the coupling beam 5 are integrated. The "left side" concerning the upper swing body 7, the carrier 4, and the coupling beam 5 means a left side at the time when the upper swing body 7, the carrier 4, and the coupling beam 5 are viewed from the rear side toward the front side thereof in a state in which the upper swing body 7, the carrier 4, and the coupling beam 5 are integrated.

The swing-body driving device 8 (see FIG. 5) is a device that causes the upper swing body 7 to swing around the vertical axis C1. The swing-body driving device 8 includes, as shown in FIG. 6, the swing motor 36, a hydraulic circuit 37, and a not-shown transmission device.

The swing motor 36 is a hydraulic motor. The hydraulic oil is supplied to the swing motor 36, whereby the swing motor 36 operates to generate power for swinging the upper swing body 7. The swing motor 36 is an example of the main-body driving motor in the present invention. The not-shown transmission device transmits the power generated by the swing motor 36 between the lower traveling body 6 and the upper swing body main body 24 to swing the upper swing body 7 with respect to the lower traveling body 6. The swing motor 36 includes a first supply/discharge port 36*a* and a second supply/discharge port 36*b*. The hydraulic oil is supplied to the first supply/discharge port 36*a*, whereby the swing motor 36 swings the upper swing body 7 clockwise. The hydraulic oil is supplied to the second supply/discharge port 36*b*, whereby the swing motor 36 causes the upper swing body 7 to swing counterclockwise.

The hydraulic circuit 37 includes a control valve 38, a supply pipe 40, a return pipe 41, a first conduit 42, and a second conduit 43.

The control valve 38 is provided in a supply route of the hydraulic oil between the hydraulic pump 14 and the swing motor 36 and is configured to control a supply flow rate of the hydraulic oil to the swing motor 36. Specifically, a stroke of a spool of the control valve 38 changes to increase the supply flow rate of the hydraulic oil to the swing motor 36 as a supplied pilot pressure increases, whereby the control valve 38 controls the supply flow rate of the hydraulic oil. The control valve 38 is connected to the hydraulic pump 14 via the supply pipe 40 and connected to a tank 46 via the return pipe 41. The control valve 38 is connected to the first supply/discharge port 36*a* of the swing motor 36 via the first conduit 42 and connected to the second supply/discharge port 36*b* of the swing motor 36 via the second conduit 43.

The control valve 38 is configured to take a first supply position 38*a*, a second supply position 38*b*, and a supply stop position 38*c*. In the first supply position 38*a*, the control valve 38 connects the supply pipe 40 to the first conduit 42 and connects the return pipe 41 to the second conduit 43. In the second supply position 38*b*, the control valve 38 connects the supply pipe 40 to the second conduit 43 and connects the return pipe 41 to the first conduit 42. In the supply stop position 38*c*, the control valve 38 does not connect the supply pipe 40 and the return pipe 41 to the first conduit 42 and the second conduit 43.

The control valve 38 includes a first pilot port 39*a* and a second pilot port 39*b*. A pilot pressure is supplied to the first pilot port 39*a*, whereby the control valve 38 takes the first supply position 38*a*. The pilot pressure is supplied to the second pilot port 39*b*, whereby the control valve 38 takes the second supply position 38*b*. When the pilot pressure is not supplied to both of the first and second pilot ports 39*a* and 39*b*, the control valve 38 takes the supply stop position 38*c*.

In the first supply position 38*a*, the control valve 38 leads the hydraulic oil, which is discharged from the hydraulic pump 14 to the supply pipe 40, to the first conduit 42. Consequently, the hydraulic oil is supplied from the first conduit 42 to the first supply/discharge port 36*a* of the swing motor 36. As a result, the swing motor 36 operates to cause the upper swing body 7 (see FIG. 1) to swing clockwise. The hydraulic oil is discharged from the second supply/discharge port 36*b* of the swing motor 36. In the first supply position 38*a*, the control valve 38 leads the hydraulic oil, which is discharged from the second supply/discharge port 36*b* of the swing motor 36 to the second conduit 43, from the second conduit 43 to the return pipe 41. Consequently, the hydraulic oil returns to the tank 46 through the return pipe 41.

In the second supply position 38*b*, the control valve 38 leads the hydraulic oil, which is discharged from the hydraulic pump 14 to the supply pipe 40, to the second conduit 43. Consequently, the hydraulic oil is supplied from the second conduit 43 to the second supply/discharge port 36*b* of the swing motor 36. As a result, the swing motor 36 operates to cause the upper swing body 7 to swing counterclockwise. The hydraulic oil is discharged from the first supply/discharge port 36*a* of the swing motor 36. In the second supply position 38*b*, the control valve 38 leads the hydraulic oil, which is discharged from the first supply/discharge port 36*a* of the swing motor 36 to the first conduit 42, from the first conduit 42 to the return pipe 41. Consequently, the hydraulic oil returns to the tank 46 through the return pipe 41.

In the supply stop position 38*c*, the control valve 38 disconnects the supply pipe 40 and the return pipe 41 from the first conduit 42 and the second conduit 43. Consequently, the hydraulic oil is not supplied from the hydraulic pump 14 to both of the first supply/discharge port 36*a* and the second supply/discharge port 36*b* of the swing motor 36. As a result, the operation of the swing motor 36 is stopped and a driving force for swinging the upper swing body 7 is not given to the upper swing body 7.

A pilot pressure source 47 and a pilot-pressure control device 48 are incidentally provided in the hydraulic circuit 37. The pilot pressure source 47 and the pilot-pressure control device 48 are explained below.

The traveling operation device 9 (see FIG. 5) is used for instructing traveling (forward and reverse) and a traveling stop of the crane main body 3. The traveling operation device 9 is provided in an operator's cab 24*a* (see FIG. 1) included in the upper swing body 7. The traveling operation device 9 includes a traveling operation lever 9*a* configured to be operated to instruct one of the forward traveling and the reverse traveling of the lower traveling body 6. In the following explanation, the traveling operation lever 9*a* is simply referred to as lever 9*a*.

The lever 9*a* is capable of tilting among a neutral position, a forward position, and a reverse position. The neutral position is a position for instructing a stop of traveling of the lower traveling body 6. The forward position is a position on one side of the neutral position and is a position for instructing the forward traveling of the lower traveling body 6. The reverse position is a position on the opposite side of the one side of the neutral position and is a position for instructing the reverse traveling of the lower traveling body 6. The crawler device 20 drives the lower traveling body 6 forward according to operation for tilting the lever 9*a* from the neutral position to the forward position. The crawler device 20 drives the lower traveling body 6 backward according to operation for tilting the lever 9*a* from the neutral position to the reverse position.

The swing operation device 10 (see FIG. 5) is used to instruct a swing (a right swing or a left swing) and a swing stop of the upper swing body 7. The swing operation device 10 is provided in the operator's cab 24*a* (see FIG. 1) included in the upper swing body 7. The swing operation device 10 includes a swing operation lever 10*a* configured to be operated to instruct one of the right swing and the left swing of the upper swing body 7. The swing operation lever 10*a* is an example of the operation section in the present invention. In the following explanation, the swing operation lever 10*a* is simply referred to as lever 10*a*.

The lever 10*a* is capable of tilting among a neutral position, a right swing position, and a left swing position. The neutral position is a position for instructing a stop of a swing of the upper swing body 7. The right swing position is a position on one side of the neutral position and is a position for instructing a right swing of the upper swing body 7. The left swing position is a position on the opposite side of the one side of the neutral position and is a position for instructing a left swing of the upper swing body 7. The swing-body driving device 8 causes the upper swing body 7 to swing to the right according to operation for tilting the lever 10*a* from the neutral position to the right swing position. The swing-body driving device 8 causes the upper swing body 7 to swing to the left according to operation for tilting the lever 10*a* from the neutral position to the left swing position.

The coupling beam 5 (see FIG. 1) extends from the upper swing body 7 (the upper swing body main body 24) to the back of the upper swing body 7. Specifically, the front end portion of the coupling beam 5 is connected to the rear end portion of the upper swing body main body 24 by a not-shown pin extending in the left-right direction (the horizontal direction) of the upper swing body 7. The coupling beam 5 projects from the rear end portion of the upper swing body main body 24 and extends backward along the front-back direction of the upper swing body main body 24. The coupling beam 5 is detachably attachable to the upper swing body main body 24 by being connected to the upper swing body main body 24 by the pin. In the coupled state of the crane 2, the coupling beam 5 is connected to the upper swing body main body 24. In the uncoupled state of the crane 2, the coupling beam 5 is detached from the upper swing body main body 24. In a state in which the coupling beam 5 is connected the upper swing body main body 24 by the pin, the coupling beam 5 is capable of slightly swinging up and down with the pin as an axis.

The carrier 4 (see FIG. 1) is disposed in a position apart from the upper swing body 7 to the back of the upper swing body 7. The carrier 4 is capable of moving (self-traveling) according to a movement of the crane main body 3 (the traveling of the crane main body 3 or the swing of the upper swing body 7). The carrier 4 is mounted with a counterweight 27 on the carrier 4, coupled to the distal end portion of the mast 28 of the work device 25 via the carrier guyline 32 as explained above, and coupled to the rear portion of the upper swing body main body 24 via the coupling beam 5 to thereby balance a hoisting load applied to the front portion of the upper swing body 7 during hoist work, a load of the boom 26, and the like and increase stability of the crane 2. Consequently, the carrier 4 improves a hoisting ability of the crane 2. That is, a hoisting load applied to the front portion of the upper swing body 7 from the work device 25, a load of the boom 26, and the like are transmitted to the carrier 4 via the carrier guyline 32. When a load transmitted to the carrier 4 is relatively small, the carrier 4 is in the grounded state in which the carrier 4 is in contact with a ground G as shown in FIG. 1. On the other hand, when the load transmitted to the carrier 4 is extremely large, since the coupling beam 5 is capable of slightly swinging up and down as explained above, the carrier 4 is sometimes in the afloat state in which the carrier 4 is afloat above the ground G as shown in FIG. 2.

Figure 4:
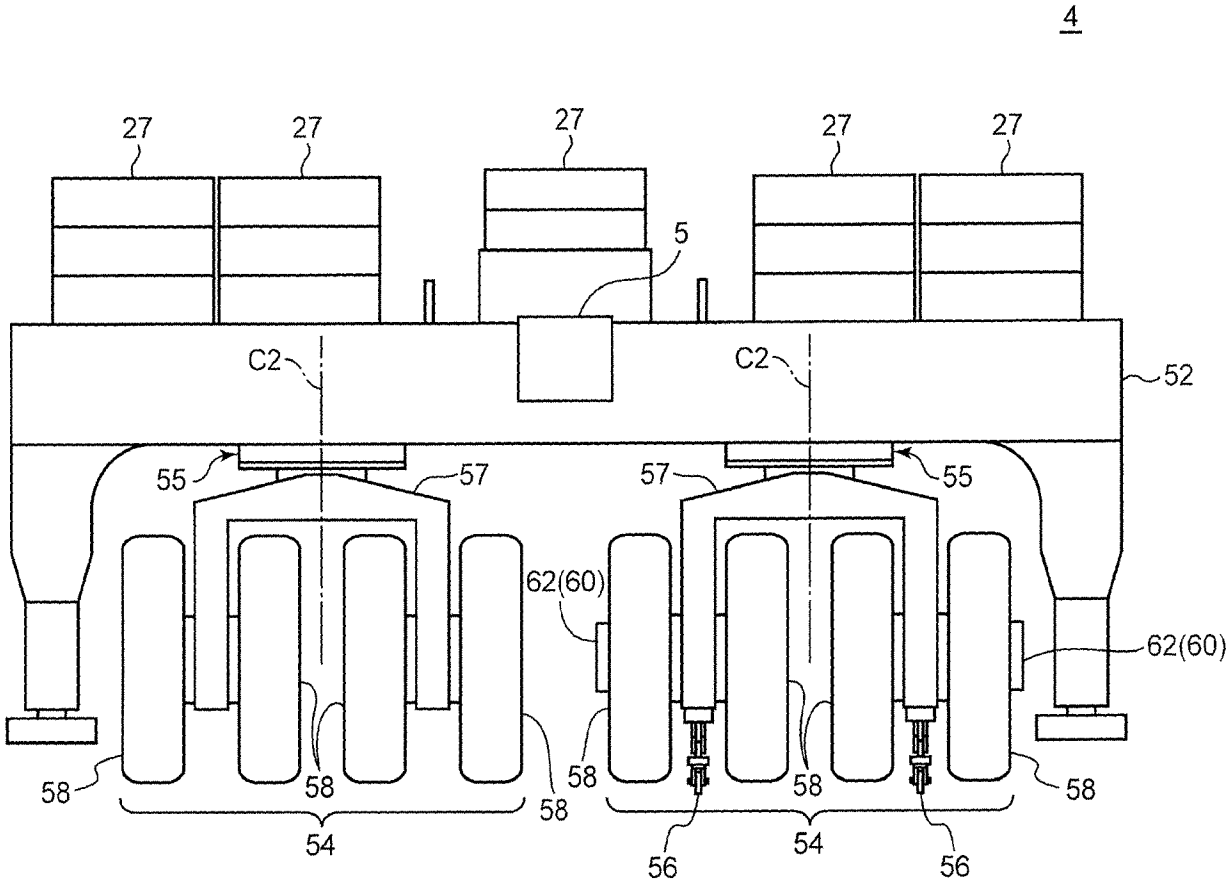
FIG. 4 is a diagram of the counterweight carrier of the mobile crane according to the embodiment of the present invention viewed from the rear side.
Figure 5:
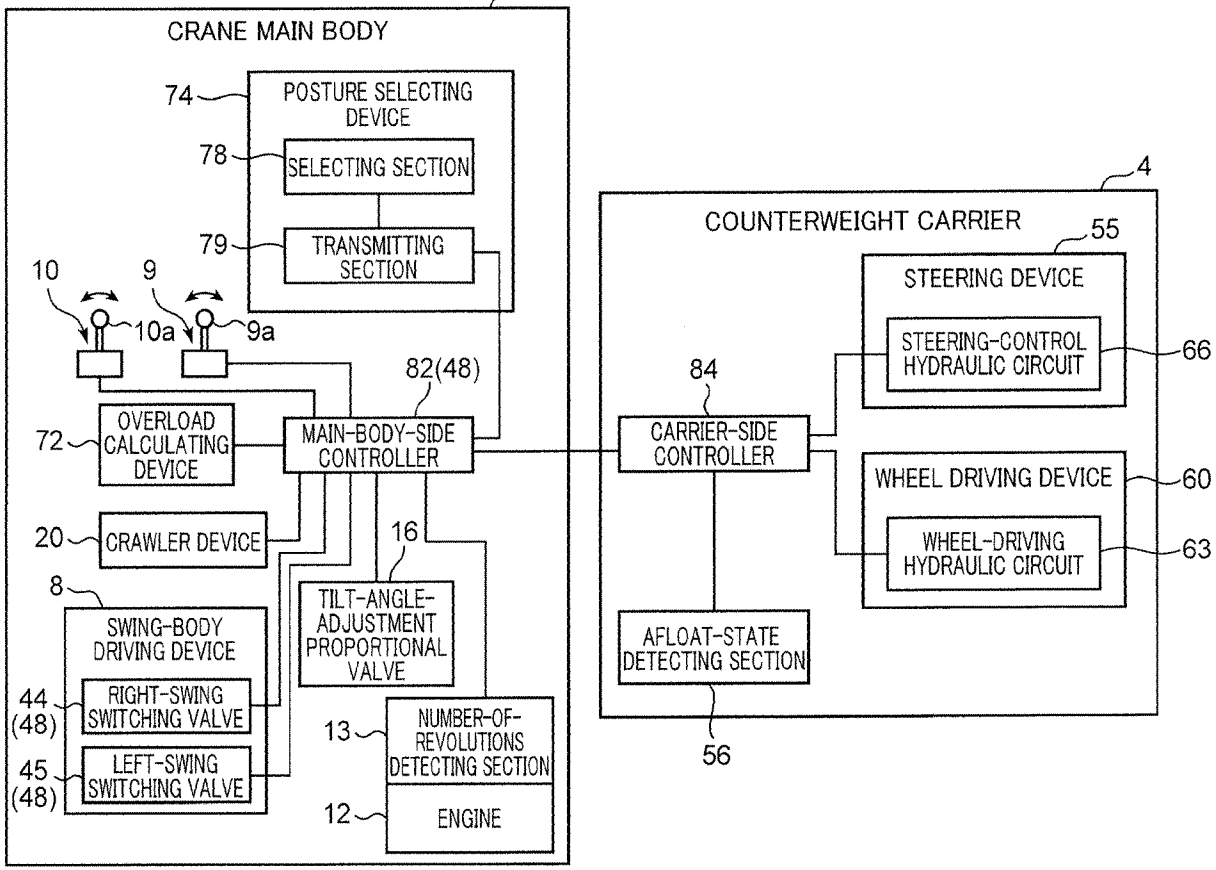
FIG. 5 is a functional block diagram of a control system of the mobile crane.
Figure 6:
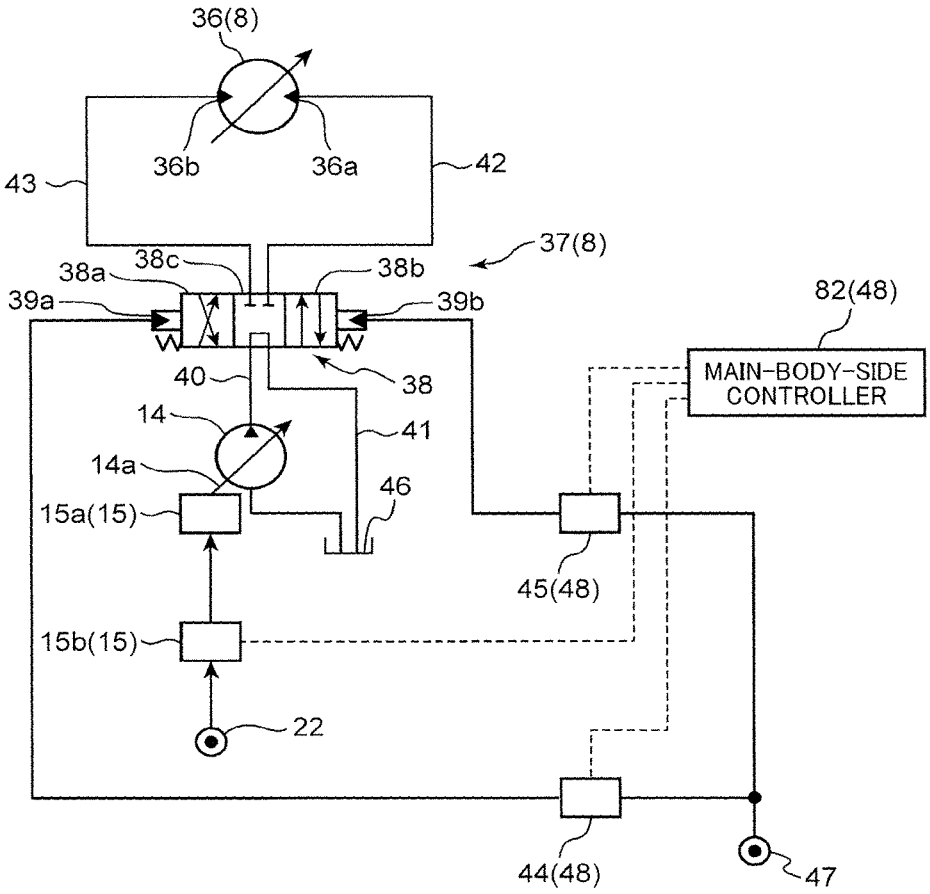
FIG. 6 is a hydraulic circuit diagram of a swing-body driving device.

The carrier 4 includes, as shown in FIG. 4, a carrier frame 52, a pair of wheel units 54, a pair of steering devices 55, an afloat-state detecting section 56, and a carrier-side controller 84 (see FIG. 5).

The carrier frame 52 is a frame functioning as a base of the carrier 4. The carrier frame 52 is connected to a rear part of the coupling beam 5 in the coupled state. The counterweight 27 (see FIG. 1) is loaded on the carrier frame 52.

The pair of wheel units 54 is attached to the carrier frame 52. The pair of wheel units 54 is disposed on the lower side of the carrier frame 52 and disposed side by side on the left and the right. Each of the wheel units 54 includes a unit frame 57 and a plurality of wheels 58.

The unit frame 57 is attached to the carrier frame 52 to be capable of turning around a vertical axis C2. Consequently, the wheel unit 54 is capable of turning around the vertical axis C2. The plurality of wheels 58 are supported by the unit frame 57 to be capable of rotating in both directions around the horizontal axis orthogonal to the vertical axis C2.

One wheel unit 54 of the pair of wheel units 54 includes a wheel driving device 60 that rotates the wheels 58 of the wheel unit 54 around axes of the wheels 58. The wheel driving device 60 includes the wheel driving motor 62 (see FIG. 4), a wheel-driving hydraulic circuit 63 (see FIG. 5), and a not-shown hydraulic pump provided in the carrier 4.

The wheel driving motor 62 is a hydraulic motor supplied with the hydraulic oil to thereby generate a driving force for rotating the wheels 58 in order to move the carrier 4 according to a movement of the crane main body 3. The wheel driving motor 62 is an example of a carrier driving motor in the present invention.

The wheel-driving hydraulic circuit 63 is connected to the not-shown hydraulic pump provided in the carrier 4. When the state concerning the carrier 4 of the crane 2 is the coupled state, the hydraulic pump is connected to the tank 46 (see FIG. 6) provided in the crane main body 3. The hydraulic pump sends the hydraulic oil from the tank 46 to the wheel driving motor 62 side. The wheel-driving hydraulic circuit 63 controls a supply flow rate of the hydraulic oil, which is sent from the hydraulic pump, to the wheel driving motor 62 and controls the operation of the wheel driving motor 62 that rotates the wheels 58.

The steering device 55 (see FIG. 4) is annexed to each of the pair of wheel units 54. The steering device 55 turns the unit frame 57 of the wheel unit 54 corresponding to the steering device 55 with respect to the carrier frame 52 around the vertical axis C2 and integrally steers the plurality of wheels 58 of the wheel unit 54. The steering device 55 includes a not-shown steering motor and a steering-control hydraulic circuit 66 (see FIG. 5). The steering motor is a hydraulic motor that generates power for steering the wheel unit 54. The steering-control hydraulic circuit 66 is configured to control the operation of the steering motor. The steering-control hydraulic circuit 66 is configured to control supply of the hydraulic oil to the steering motor so as to control the operation of the steering motor that steers the wheel unit 54.

Figure 7:
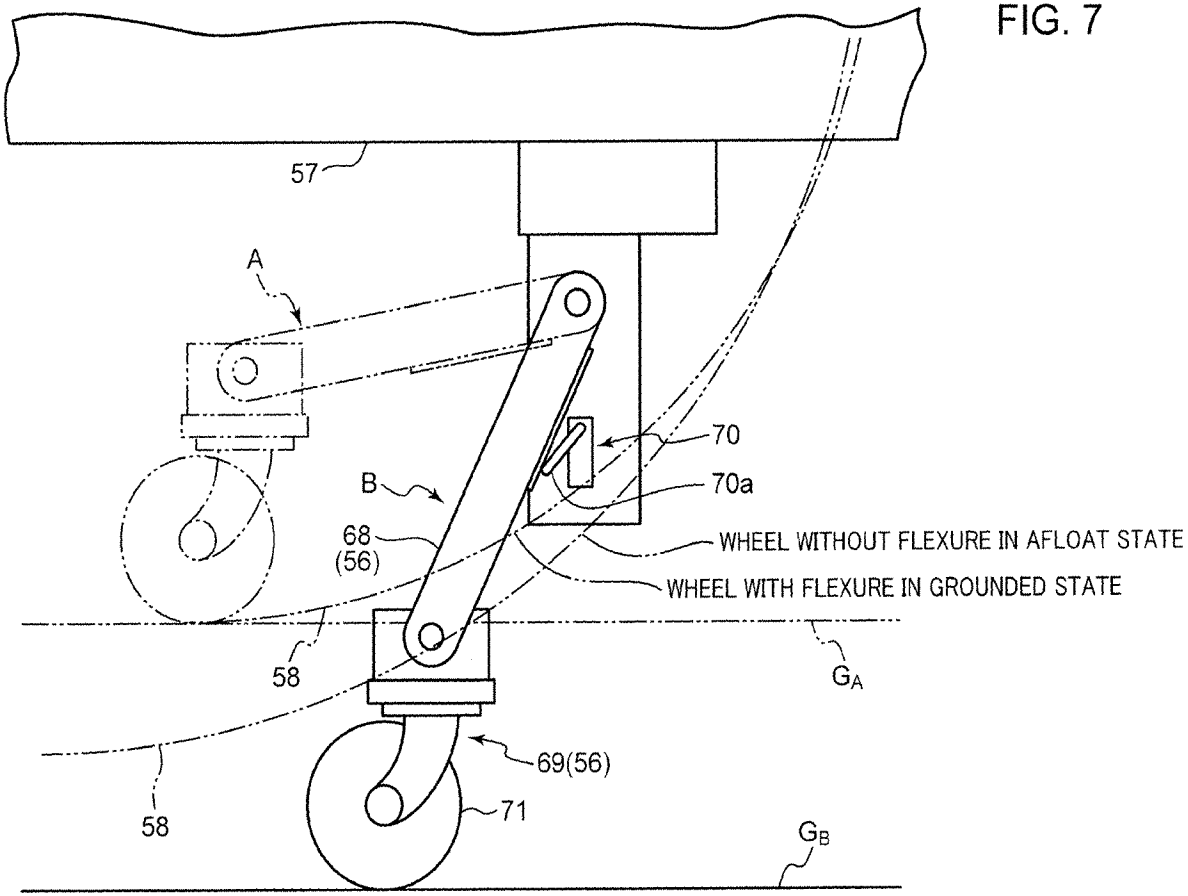
FIG. 7 is a diagram showing an afloat-state detecting section of the counterweight carrier.

The afloat-state detecting section 56 is configured to detect a state taken by the carrier 4 out of the grounded state in which the carrier 4 coupled to the upper swing body 7 of the crane main body 3 is in contact with the ground G and the afloat state in which the carrier 4 is afloat above the ground G. The afloat-state detecting section 56 is specifically configured as shown in FIG. 7.

The afloat-state detecting section 56 includes an arm 68, a caster 69, and a limit switch 70.

The aim 68 is attached to the unit frame 57 such that one end portion of the arm 68 is capable of swinging around a horizontal axis parallel to a horizontal axis that is a rotation center of the wheel 58. Consequently, the aim 68 is capable of swinging up and down with the one end portion as a fulcrum.

The caster 69 is attached to an end portion on the opposite side of the one end portion of the arm 68 attached to the unit frame 57. The caster 69 is attached to the end portion on the opposite side of the arm 68 to be capable of relatively turning around the horizontal axis parallel to the horizontal axis that is the rotation center of the wheel 58. The caster 69 includes a caster wheel 71 capable of rotating around the horizontal axis parallel to the horizontal axis that is the rotation center of the wheel 58. In a state in which the wheel 58 of the carrier 4 is in the grounded state, the caster wheel 71 is in contact with the ground G and rolls on the ground G according to the movement of the carrier 4. In the grounded state of the carrier 4, the wheel 58 is in contact with a ground $G_A$ in a state in which the wheel 58 has a flexure caused by the weight of the carrier 4. The arm 68 is in a state A (see FIG. 7) in which the caster wheel 71 is in contact with the ground $G_A$ in a posture of the arm 68 swung to a position close to the horizontal. On the other hand, in the afloat state of the carrier 4, the wheel 58 does not have the flexure and is afloat above a ground $G_B$ and the arm 68 is in a state B (see FIG. 7) in which the caster wheel 71 is in contact with the ground $G_B$ in a posture of the arm 68 swung downward from the posture in the grounded state. The swing of the arm 68 from the state A to the state B is performed by the own weight of the caster 69.

The limit switch 70 is configured to detect that the state of the carrier 4 has changed to the afloat state by a movement of the arm 68 at the time when the state of the carrier 4 has changed to the afloat state. Specifically, when the state of the carrier 4 has changed to the afloat state so that the state of the arm 68 has changed to the state B, the lever 70*a* of the limit switch 70 is pushed by the arm 68. By detecting that the lever 70*a* is pushed, the limit switch 70 detects that the state of the carrier 4 has changed to the afloat state. The lever 70*a* is pushed by the arm 68, whereby the limit switch 70 is turned on and outputs a detection signal to the carrier-side controller 84. On the other hand, when the carrier 4 is in the grounded state and the arm 68 is in the state A, the arm 68 is separated from the lever 70*a* of the limit switch 70 and the lever 70*a* is not pushed. Therefore, the limit switch 70 is off. In the off state, the limit switch 70 does not output the detection signal to the carrier-side controller 84.

The carrier-side controller 84 is configured to perform control of the operation of the carrier 4. When the carrier 4 is in the coupled state, the carrier-side controller 84 is connected to the main-body-side controller 82 (explained below) via a communication line. When the carrier 4 is in the coupled state, the carrier-side controller 84 controls the operation of the carrier 4 according to a command signal transmitted from the main-body-side controller 82 to the carrier-side controller 84 via the communication line. When the carrier 4 is in the coupled state, the carrier-side controller 84 transmits a connection signal to the main-body-side controller 82 via the communication line.

In this embodiment, the crane main body 3 includes an overload calculating device 72, a posture selecting device 74, the pilot pressure source 47, and the pilot-pressure control device 48.

The overload calculating device 72 is configured to calculate a load applied to the work device 25 during the hoisting work and discriminate whether the load is an excessive load exceeding the hoisting ability of the crane 2. The overload calculating device 72 is provided in the crane main body 3. Various kinds of information are input by a not-shown input device prior to implementation of the hoisting work, whereby a use pattern of the crane 2 in the hoisting work is set. The various kinds of work input by the input device are, for example, information concerning the length of the boom 26, information concerning which of the coupled state and the uncoupled state the state of the carrier 4 is, and information such as the number of stages of the counterweight 27 loaded on the carrier 4.

The overload calculating device 72 derives a load value serving as the hoisting ability of the crane 2 on the basis of the set use pattern of the crane 2 and the various kinds of information input by the input device. The overload calculating device 72 derives the state taken by the carrier 4 out of the coupled state and the uncoupled state on the basis of whether the derived load value is equal to or larger than a reference value and whether the connection signal is input to the main-body-side controller 82 (explained below) from the carrier-side controller 84. That is, the overload calculating device 72 is an example of the coupled-state deriving section in the present invention. In the coupled state, the load value of the hoisting ability of the crane 2 derived by the overload calculating device 72 is high. In the uncoupled state, the load value of the hoisting ability of the crane 2 derived by the overload calculating device 72 is lower than the load value derived in the coupled state. In the overload calculating device 72, a reference value concerning the load value of the hoisting ability for discriminating the coupled state and the uncoupled state of the crane 2 is incorporated. When the derived load value of the hoisting ability is equal to or larger than the reference value and the connection signal is input to the main-body-side controller 82 from the carrier-side controller 84, the overload calculating device 72 discriminates that the crane 2 is in the coupled state. When the derived load value of the hoisting ability is smaller than the reference value and the connection signal is not input to the main-body-side controller 82, the overload calculating device 72 discriminates that the crane 2 is in the uncoupled state.

The posture selecting device 74 (see FIG. 5) is used by an operator to select postures around the vertical axis C2 of the wheel units 54 of the carrier 4. The posture selecting device 74 is provided in the crane main body 3. As postures of the wheel unit 54 selectable by the posture selecting device 74, there are a traveling posture and a swing posture.

The traveling posture is a posture set during traveling of the crane main body 3 by the lower traveling body 6. Specifically, the traveling posture is a posture in which the wheels 58 of the wheel unit 54 face a traveling direction of the lower traveling body 6. The swing posture is a posture set during swinging of the upper swing body 7. Specifically, the swing posture is a posture in which the wheels 58 of the wheel unit 54 face a direction along a swing direction of the upper swing body 7.

The posture selecting device 74 includes a selecting section 78 and a transmitting section 79.

The selecting section 78 is configured by a selection button and the like operated to select a posture of the wheel unit 54. That is, whether the wheel unit 54 is caused to take the traveling posture or the swing posture is instructed by the operation of the selecting section 78.

The transmitting section 79 is configured to transmit a signal indicating the posture selected by the operation of the selecting section 78 to the main-body-side controller 82 (explained below).

The pilot pressure source 47 is configured to supply a pilot pressure. The pilot-pressure control device 48 is configured to control the pilot pressure supplied from the pilot pressure source 47 to the first and second pilot ports 39*a* and 39*b* of the control valve 38.

When the state of the carrier 4 derived by the overload calculating device 72 is the uncoupled state, the pilot-pressure control device 48 controls the pilot pressure such that the pilot pressure supplied to the control valve 38 increases at a first ratio according to an increase in an operation amount of the lever 10*a*. When the state of the carrier 4 derived by the overload calculating device 72 is the coupled state and the state of the carrier 4 detected by the afloat-state detecting section 56 is the grounded state, the pilot-pressure control device 48 controls the pilot pressure such that the pilot pressure supplied to the control valve 38 increases at a second ratio lower than the first ratio according to the increase in the operation amount of the lever 10*a*. When the state of the carrier 4 derived by the overload calculating device 72 is the coupled state and the state of the carrier 4 detected by the afloat-state detecting section 56 is the afloat state, the pilot-pressure control device 48 controls the pilot pressure such that the pilot pressure supplied to the control valve 38 increases at a third ratio higher than the second ratio and lower than the first ratio according to the increase in the operation amount of the lever 10*a*.

The pilot-pressure control device 48 includes a right-swing switching valve 44, a left-swing switching valve 45, and the main-body-side controller 82.

The right-swing switching valve 44 is provided in a supply route of the pilot pressure between the first pilot port 39*a* of the control valve 38 and the pilot pressure source 47. The left-swing switching valve 45 is provided in a supply route of the pilot pressure between the second pilot port 39*b* of the control valve 38 and the pilot pressure source 47. The right-swing switching valve 44 and the left-swing switching valve 45 are an example of the proportional solenoid valve in the present invention.

The right-swing switching valve 44 is a proportional solenoid valve that switches supply and non-supply of the pilot pressure to the first pilot port 39*a*. The left-swing switching valve 45 is a proportional solenoid valve that switches supply and non-supply of the pilot pressure to the second pilot port 39*b*. An electric current is input to the right-swing switching valve 44 from the main-body-side controller 82 (explained below), whereby the state of the right-swing switching valve 44 changes to an open state for allowing the supply of the pilot pressure to the first pilot port 39*a*. When the electric current is not input to the right-swing switching valve 44, the state of the right-swing switching valve 44 changes to a closed state for blocking the supply of the pilot pressure to the first pilot port 39*a*. An electric current is input to the left-swing switching valve 45 from the main-body-side controller 82 (explained below), whereby the state of the left-swing switching valve 45 changes to an open state for allowing the supply of the pilot pressure to the second pilot port 39*b*. When the electric current is not input to the left-swing switching valve 45, the state of the left-swing switching valve 45 changes to a closed state for blocking the supply of the pilot pressure to the second pilot port 39*b*.

The right-swing switching valve 44 sets the pilot pressure supplied to the first pilot port 39*a* to pressure having magnitude corresponding to the electric current input to the right-swing switching valve 44. Specifically, the right-swing switching valve 44 adjusts the pilot pressure such that the pilot pressure supplied to the first pilot port 39*a* increases as the electric current input to the right-swing switching valve 44 increases. Consequently, as the electric current input to the right-swing switching valve 44 increases, a flow rate of the hydraulic oil supplied to the first supply/discharge port 36*a* of the swing motor 36 through the control valve 38 increases. According to the increase in the flow rate of the hydraulic oil, a driving force of the swing motor 36 that causes the upper swing body 7 to swing clockwise increases.

The left-swing switching valve 45 sets the pilot pressure supplied to the second pilot port 39*b* to pressure having magnitude corresponding to the electric current input to the left-swing switching valve 45. Specifically, the left-swing switching valve 45 adjusts the pilot pressure such that the pilot pressure supplied to the second pilot port 39*b* increases as the electric current input to the left-swing switching valve 45 increases. Consequently, as the electric current input to the left-swing switching valve 45 increases, a flow rate of the hydraulic oil supplied to the second supply/discharge port 36*b* of the swing motor 36 through the control valve 38 increases. According to the increase in the flow rate of the hydraulic oil, a driving force of the swing motor 36 that causes the upper swing body 7 to swing counterclockwise increases.

The main-body-side controller 82 is configured to perform control of the operation of the crane main body 3. The main-body-side controller 82 is an example of the controller in the present invention. The main-body-side controller 82 is configured to transmit a command signal to the carrier-side controller 84 to thereby cause the carrier-side controller 84 to execute control of the operation of the carrier 4 corresponding to the command signal.

Specifically, when a traveling posture is selected by the operation of the selecting section 78 and a signal indicating that the traveling posture is selected is received from the transmitting section 79, the main-body-side controller 82 transmits a command signal to the carrier-side controller 84 to cause the carrier-side controller 84 to control the steering device 55. According to the control, the main-body-side controller 82 causes the steering devices 55 to steer the wheel units 54 such that the wheel units 54 take the traveling posture. When a swing posture is selected by the operation of the selecting section 78 and a signal indicating that the swing posture is selected is received from the transmitting section 79, the main-body-side controller 82 transmits a command signal to the carrier-side controller 84 to cause the carrier-side controller 84 to control the steering devices 55. According to the control, the main-body-side controller 82 causes the steering devices 55 to steer the wheel units 54 such that the wheel units 54 take the swing posture.

When the lever 9*a* is tilted from the neutral position to the forward position, according to the operation, the main-body-side controller 82 causes the crawler devices 20 to operate such that the lower traveling body 6 travels forward. The main-body-side controller 82 outputs, to the carrier-side controller 84, a command signal for instructing the forward traveling of the carrier 4. The carrier-side controller 84 causes the wheel driving device 60 to rotate the wheels 58 such that the carrier 4 travels forward, by receiving the command signal for instructing the forward traveling of the carrier 4. When the lever 9*a* is tilted from the neutral position to the reverse position, according to the operation, the main-body-side controller 82 causes the crawler devices 20 to operate such that the lower traveling body 6 travels backward. The main-body-side controller 82 outputs, to the carrier-side controller 84, a command signal for instructing the backward traveling of the carrier 4. The carrier-side controller 84 causes the wheel driving device 60 to rotate the wheels 58 such that the carrier 4 travels backward, by receiving the command signal for instructing the backward traveling of the carrier 4.

When the lever 10*a* is tilted from the neutral position to the right swing position, according to the operation, the main-body-side controller 82 causes the swing-body driving device 8 to swing the upper swing body 7 to the right and outputs, to the carrier-side controller 84, a command signal for instructing movement of the carrier 4 in the swing direction of the upper swing body 7. The carrier-side controller 84 causes the wheel driving device 60 to rotate the wheels 58 such that the carrier 4 moves in the right swing direction of the upper swing body 7, by receiving the command signal for instructing movement of the carrier 4 in the swing direction of the upper swing body 7. When the lever 10*a* is tilted from the neutral position to the left swing position, according to the operation, the main-body-side controller 82 causes the swing-body driving device 8 to swing the upper swing body 7 to the left and outputs, to the carrier-side controller 84, a command signal for instructing movement of the carrier 4 in the swing direction of the upper swing body 7. The carrier-side controller 84 causes the wheel driving device 60 to rotate the wheels 58 such that the carrier 4 moves in the left swing direction of the upper swing body 7, by receiving the command signal for instructing movement of the carrier 4 in the swing direction of the upper swing body 7.

When causing the swing-body driving device 8 to swing the upper swing body 7, the main-body-side controller 82 inputs an electric current to a switching valve, corresponding to a side where the lever 10*a* is operated, out of the right-swing switching valve 44 and the left-swing switching valve 45 and causes the switching valve to allow supply of the pilot pressure to a pilot port, corresponding to the switching valve, out of the first pilot port 39*a* and the second pilot port 39*b* of the control valve 38. Consequently, the control valve 38 takes a supply position, corresponding to the pilot port to which the pilot pressure is supplied, out of the first supply position 38*a* and the second supply position 38*b*. Accordingly, the hydraulic oil is supplied to a supply/discharge port, corresponding to the supply position that the control valve 38 takes, out of the first supply/discharge port 36*a* and the second supply/discharge port 36*b* of the swing motor 36. As a result, the swing motor 36 causes the upper swing body 7 to swing a direction corresponding to the side where the lever 10*a* is operated.

When inputting the electric current to the switching valve corresponding to the side where the lever 10*a* is operated, the main-body-side controller 82 inputs, to the switching valve, an electric current having magnitude corresponding to an operation amount from the neutral position of the lever 10*a*. Specifically, the main-body-side controller 82 has stored therein an operation amount/current relation that specifies a correlation between the operation amount from the neutral position of the lever 10*a* and a current value. The main-body-side controller 82 derives, on the basis of the stored operation amount/current relation, a current value corresponding to data of the operation amount of the lever 10*a* received from the swing operation device 10. The main-body-side controller 82 inputs an electric current equivalent to the derived current value to the switching valve. Consequently, the main-body-side controller 82 causes the switching valve to adjust the pilot pressure supplied to the control valve 38. According to the adjustment of the pilot pressure, the main-body-side controller 82 adjusts a flow rate of the hydraulic oil supplied to the swing motor 36 through the control valve 38.

The main-body-side controller 82 has stored therein, as the operation amount/current relation, a first operation amount/current relation $F_{m1}$, a second operation amount/current relation $F_{m2}$, and a third operation amount/current relation $F_{m3}$. The main-body-side controller 82 derives a current value corresponding to an operation amount of the lever 10*a* using, among the stored first to third operation amount/current relations $F_{m1}$ to $F_{m3}$, an operation amount/current relation corresponding to the state (the coupled state or the uncoupled state) of the carrier 4 discriminated by the overload calculating device 72 and the state (the afloat state or the grounded state) of the carrier 4 detected by the afloat-state detecting section 56.

The first operation amount/current relation $F_{m1}$ is used when the state of the carrier 4 discriminated by the overload calculating device 72 is the uncoupled state. The second operation amount/current relation $F_{m2}$ is used when the state of the carrier 4 discriminated by the overload calculating device 72 is the coupled state and the state of the carrier 4 detected by the afloat-state detecting section 56 is the grounded state. The third operation amount/current relation $F_{m3}$ is used when the state of the carrier 4 discriminated by the overload calculating device 72 is the coupled state and the state of the carrier 4 detected by the afloat-state detecting section 56 is the afloat state.

Figure 8:
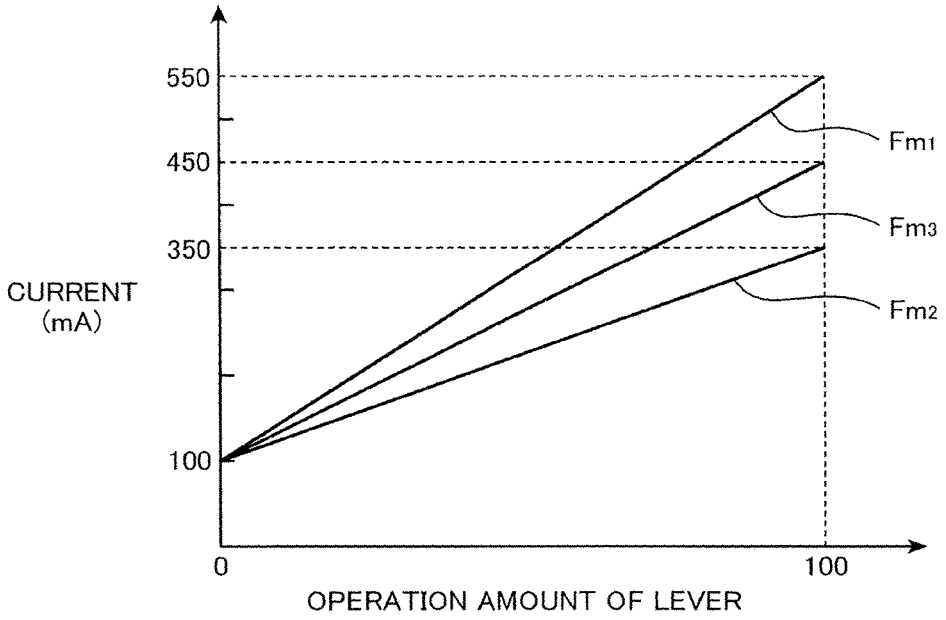
FIG. 8 is a diagram showing a correlation between an operation amount from a neutral position of a swing operation lever and a current value input to a switching valve.

The first to third operation amount/current relations $F_{m1}$ to $F_{m3}$ are shown in FIG. 8. All of the first to third operation amount/current relations $F_{m1}$ to $F_{m3}$ are linear proportional relations of the operation amount of the lever 10*a* and the current value indicating that the current value increases as the operation amount of the lever 10*a* increases. The first operation amount/current relation $F_{m1}$ is specified such that the current value increases at a first ratio according to the increase in the operation amount of the lever 10*a*. On the other hand, the second operation amount/current relation $F_{m2}$ is specified such that the current value increases at a second ratio lower than the first ratio according to the increase in the operation amount of the lever 10*a*. The third operation amount/current relation $F_{m3}$ is specified such that the current value increases at a third ratio higher than the second ratio and lower than the first ratio according to the increase in the operation amount of the lever 10*a*.

In the first to third operation amount/current relations $F_{m1}$ to $F_{m3}$, all current values at the time when the operation amount of the lever 10*a* is the minimum 0, that is, smallest current values are 100 mA. On the other hand, in the first operation amount/current relation $F_{m1}$, a current value at the time when the operation amount of the lever 10*a* is the maximum 100, that is, a largest current value is 550 mA. In the second operation amount/current relation $F_{m2}$, a current value at the time when the operation amount of the lever 10*a* is the maximum 100, that is, the largest current value is 350 mA. In the third operation amount/current relation $F_{m3}$, a current value at the time when the operation amount of the lever 10*a* is the maximum 100, that is, the largest current value is 450 mA.

The main-body-side controller 82 is configured to control a discharge flow rate of the hydraulic oil of the hydraulic pump 14 according to the number of revolutions of the engine 12 detected by the number-of-revolutions detecting section 13.

Specifically, when the state of the carrier 4 derived by the overload calculating device 72 is the uncoupled state, the main-body-side controller 82 causes the discharge-flow-rate changing device 15 to change the discharge flow rate of the hydraulic oil of the hydraulic pump 14 such that the discharge flow rate of the hydraulic oil of the hydraulic pump 14 increases as the number of revolutions of the engine 12 increases from a minimum number of revolutions.

When the state of the carrier 4 derived by the overload calculating device 72 is the coupled state, the state of the carrier 4 detected by the afloat-state detecting section 56 is the grounded state, and the wheel unit 54 of the carrier 4 takes the swing posture, the main-body-side controller 82 causes the discharge-flow-rate changing device 15 to set the discharge flow rate of the hydraulic pump 14 such that, in a range of the number of revolutions of the engine 12 between the minimum number of revolutions and a predetermined number of revolutions higher than the minimum number of revolutions, the discharge flow rate of the hydraulic oil of the hydraulic pump 14 is a discharge flow rate larger than the discharge flow rate of the hydraulic oil of the hydraulic pump 14 obtained when the state of the carrier 4 derived by the overload calculating device 72 is the uncoupled state.

More specifically, the main-body-side controller 82 controls an electric current input to the tilt-angle-adjustment proportional valve 15*b* according to the number of revolutions of the engine 12 detected by the number-of-revolutions detecting section 13 to thereby cause the tilt-angle-adjustment proportional valve 15*b* to adjust a hydraulic pressure supplied from the hydraulic pressure source 22 to the tilt-angle adjusting mechanism 15*a*. Consequently, the main-body-side controller 82 causes the tilt-angle adjusting mechanism 15*a* to adjust the tilt angle of the swash plate 14*a* of the hydraulic pump 14 and, as a result, controls the discharge flow rate of the hydraulic oil of the hydraulic pump 14.

Note that the main-body-side controller 82 has stored therein a history of steering of the wheel unit 54 by the steering device 55. The main-body-side controller 82 is capable of recognizing, on the basis of the stored history, a posture taken by the wheel unit 54 out of the traveling posture and the swing posture.

The main-body-side controller 82 has stored therein the number of revolutions/current relation that specifies a correlation between the number of revolutions of the engine 12 and a current value input to the tilt-angle-adjustment proportional valve 15*b*. The main-body-side controller 82 derives, as a value of an electric current input to the tilt-angle-adjustment proportional valve 15*b*, on the basis of the number of revolutions/current relation, a current value corresponding to the number of revolutions of the engine 12 detected by the number-of-revolutions detecting section 13. The main-body-side controller 82 has stored therein, as the number of revolutions/current relation, a first number of revolutions/current relation $F_{r1}$, a second number of revolutions/current relation $F_{r2}$, and a conversion table. The main-body-side controller 82 derives a current value corresponding to the number of revolutions of the engine 12 using, out of the first number of revolutions/current relation $F_{r1}$, the second number of revolutions/current relation $F_{r2}$, and the conversion table, the first number of revolutions/current relation $F_{r1}$, the second number of revolutions/current relation $F_{r2}$, or the conversion table corresponding to the state (the coupled state or the uncoupled state) of the carrier 4 discriminated by the overload calculating device 72, the state (the afloat state or the grounded state) of the carrier 4 detected by the afloat-state detecting section 56, and whether the wheel unit 54 of the carrier 4 is in the swing posture.

The first number of revolutions/current relation $F_{r1}$ is used when the state of the carrier 4 discriminated by the overload calculating device 72 is the uncoupled state. The second number of revolutions/current relation $F_{r2}$ is used when the state of the carrier 4 discriminated by the overload calculating device 72 is the coupled state, the state of the carrier 4 detected by the afloat-state detecting section 56 is the grounded state, and the wheel unit 54 is in the swing posture. The conversion table is used when the state of the carrier 4 discriminated by the overload calculating device 72 is the coupled state and the state of the carrier 4 detected by the afloat-state detecting section 56 is the afloat state or the posture of the wheel unit 54 is the traveling posture.

Figure 9:
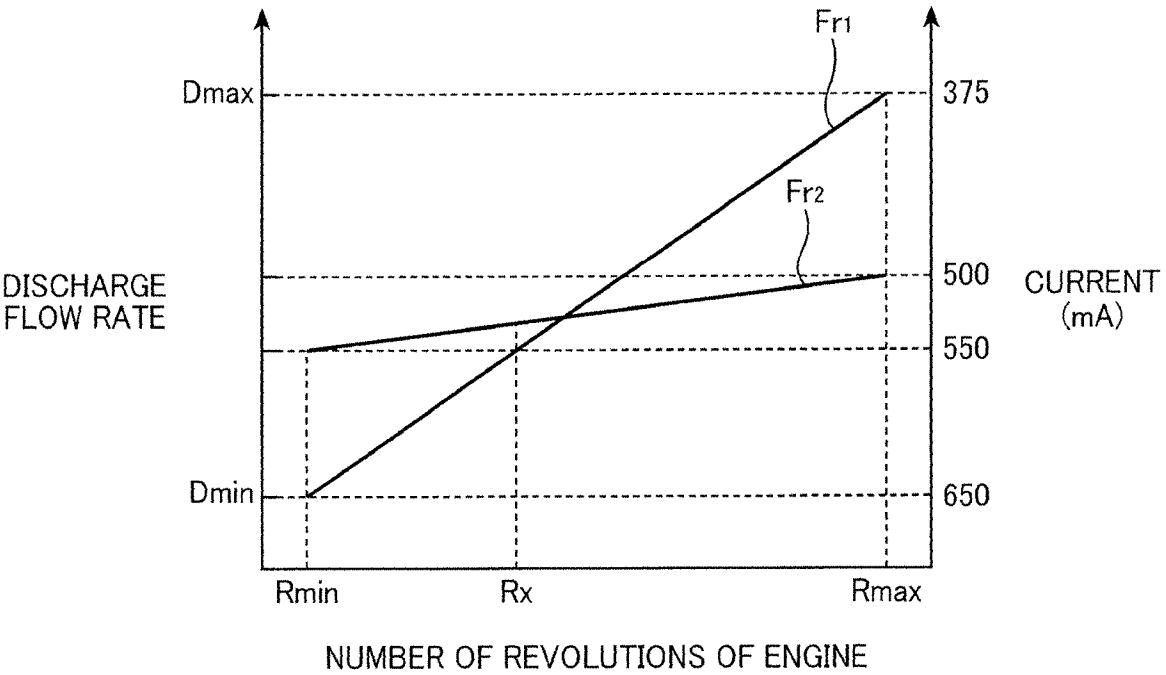
FIG. 9 is a diagram showing a correlation among a number of revolutions of an engine, a discharge flow rate of a hydraulic pump, and a current value input to a tilt-angle-adjustment proportional valve.

As shown in FIG. 9, the first number of revolutions/current relation $F_{r1}$ is specified such that the current value linearly decreases from 650 mA to 375 mA as the number of revolutions of the engine 12 increases from a minimum number of revolutions $R_{min}$ to a maximum number of revolutions $R_{max}$. Between the current value input to the tilt-angle-adjustment proportional valve 15*b* and the discharge flow rate of the hydraulic oil of the hydraulic pump 14, there is a correlation that the discharge flow rate of the hydraulic oil of the hydraulic pump 14 linearly decreases as the current value input to the tilt-angle-adjustment proportional valve 15*b* increases. Therefore, the electric current of 650 mA derived on the basis of the first number of revolutions/current relation $F_{r1}$ at the time when the number of revolutions of the engine 12 is the minimum number of revolutions $R_{min}$ is input to the tilt-angle-adjustment proportional valve 15*b*, whereby the discharge flow rate of the hydraulic oil of the hydraulic pump 14 decreases to a minimum discharge flow rate $D_{min}$. The current value derived on the basis of the first number of revolutions/current relation $F_{r1}$ increases from 650 mA according to an increase in the number of revolutions of the engine 12 and an electric current having the current value is input to the tilt-angle-adjustment proportional valve 15*b*, whereby the discharge flow rate of the hydraulic oil of the hydraulic pump 14 increases from the minimum discharge flow rate $D_{min}$. An electric current of 375 mA derived on the basis of the first number of revolutions/current relation $F_{r1}$ when the number of revolutions of the engine 12 is the maximum number of revolutions $R_{max}$ is input to the tilt-angle-adjustment proportional valve 15*b*, whereby the discharge flow rate of the hydraulic oil of the hydraulic pump 14 increases to a maximum discharge flow rate $D_{max}$.

As shown in FIG. 9, the second number of revolutions/current relation $F_{r2}$ is specified such that the current value input to the tilt-angle-adjustment proportional valve 15*b* changes according to the number of revolutions of the engine 12 within a range of 500 mA to 550 mA in the middle between the current value of 375 mA at which the discharge flow rate of the hydraulic oil of the hydraulic pump 14 is the maximum discharge flow rate $D_{max}$ and the current value of 650 mA at which the discharge flow rate of the hydraulic oil of the hydraulic pump 14 is the minimum discharge flow rate $D_{min}$.

Specifically, the second number of revolutions/current relation $F_{r2}$ is specified such that the current value linearly decreases from 550 mA to 500 mA as the number of revolutions of the engine 12 increases from the minimum number of revolutions $R_{min}$ to the maximum number of revolutions $R_{max}$. Therefore, when the number of revolutions of the engine 12 increases from the minimum number of revolutions $R_{min}$ to the maximum number of revolutions $R_{max}$, an increase rate of the discharge flow rate of the hydraulic oil of the hydraulic pump 14 at the time when the electric current derived on the basis of the second number of revolutions/current relation $F_{r2}$ is input to the tilt-angle-adjustment proportional valve 15*b* is slow compared with an increase rate at the time when the electric current derived on the basis of the first number of revolutions/current relation $F_{r1}$ is input to the tilt-angle-adjustment proportional valve 15*b*. Moreover, in a range of the number of revolutions of the engine 12 between the minimum number of revolutions $R_{min}$ and a predetermined number of revolutions $R_x$ higher than the minimum number of revolutions $R_{min}$, the discharge flow rate of the hydraulic oil of the hydraulic pump 14 at the time when the electric current derived on the basis of the second number of revolutions/current relation $F_{r2}$ is input to the tilt-angle-adjustment proportional valve 15*b* is larger than the discharge flow rate of the hydraulic oil of the hydraulic pump 14 at the time when the electric current derived on the basis of the first number of revolutions/current relation $F_{r1}$ is input to the tilt-angle-adjustment proportional valve 15*b*.

The conversion table specifies a correlation between the number of revolutions of the engine 12 and the current value input to the tilt-angle-adjustment proportional valve 15*b* different from the first number of revolutions/current relation $F_{r1}$ and the second number of revolutions/current relation $F_{r2}$. For example, the conversion table specifies a correlation between the number of revolutions of the engine 12 and the current value input to the tilt-angle-adjustment proportional valve 15*b* during the traveling of the crane main body 3 by the lower traveling body 6 and at the time when the crane main body 3 stops operation and only the carrier 4 moves.

Figure 10:
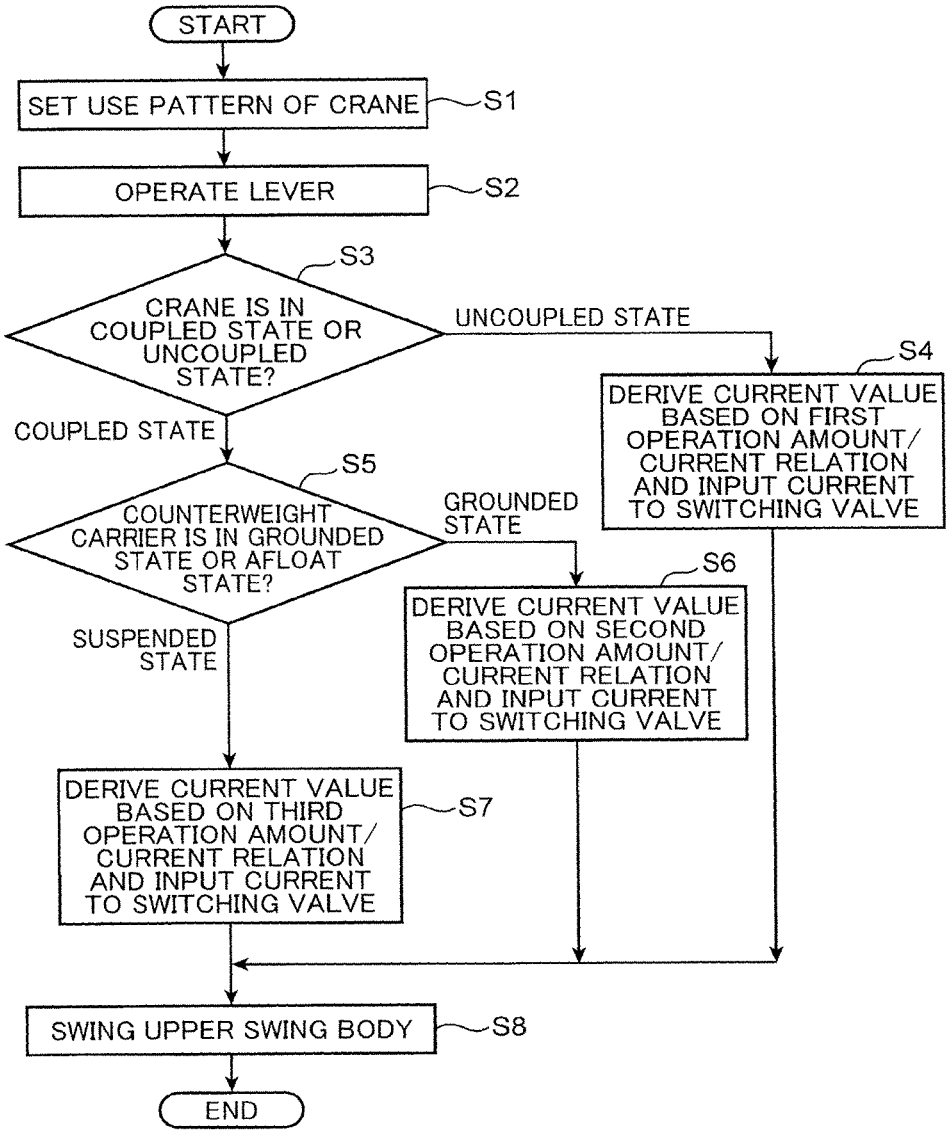
FIG. 10 is a flowchart for explaining a control process during swinging of an upper swing body.

A control process during the swing of the upper swing body 7 is explained with reference to a flowchart of FIG. 10.

First, an operator performs setting of a use pattern of the crane 2 (step S1). Specifically, the operator inputs the various kinds of information with the not-shown input device and sets a use pattern of the crane 2 in the hoisting work according to the various kinds of information. A load value serving as a hoisting ability of the crane 2 is derived by the overload calculating device 72 on the basis of the set use pattern and the input various kinds of information.

Subsequently, the operator tilts the lever 10*a* of the swing operation device 10 from the neutral position to the right swing position or the left swing position (step S2).

Subsequently, the overload calculating device 72 discriminates whether the state of the carrier 4 is the coupled state or the uncoupled state (step S3). Specifically, when the load value of the hoisting ability of the crane 2 derived as explained above is equal to or larger than the reference value and the connection signal is input to the main-body-side controller 82 from the carrier-side controller 84, the overload calculating device 72 discriminates that the state of the carrier 4 is the coupled state. When the load value of the hoisting ability is smaller than the reference value and the connection signal is not input to the main-body-side controller 82 from the carrier-side controller 84, the overload calculating device 72 discriminates that the state of the carrier 4 is the uncoupled state. Note that, when the connection signal is not input to the main-body-side controller 82 although the load value of the hoisting ability is equal to or larger than the reference value or when the connection signal is input to the main-body-side controller 82 although the load value of the hoisting ability is smaller than the reference value, the overload calculating device 72 discriminates that an error has occurred.

When the overload calculating device 72 discriminates in step S3 that the state of the carrier 4 is the uncoupled state, subsequently, the main-body-side controller 82 derives, on the basis of the first operation amount/current relation $F_{m1}$ (see FIG. 8), a current value corresponding to the operation amount from the neutral position of the lever 10*a* operated in step S2 and inputs an electric current equivalent to the derived current value to the switching valve, corresponding to the side where the lever 10*a* is operated, out of the right-swing switching valve 44 and the left-swing switching valve 45 (step S4). That is, when the lever 10*a* is operated to a right-swing position side, the main-body-side controller 82 inputs the electric current equivalent to the derived current value to the right-swing switching valve 44. When the lever 10*a* is operated to a left-swing position side, the main-body-side controller 82 inputs the electric current equivalent to the derived current value to the left-swing switching valve 45.

The electric current is input to the right-swing switching valve 44 or the left-swing switching valve 45, whereby the control valve 38 allows the supply of the hydraulic oil to the swing motor 36. As a result, the swing motor 36 supplied with the hydraulic oil causes the upper swing body 7 to swing (step S8).

Specifically, when the electric current is input to the right-swing switching valve 44, a pilot pressure corresponding to the magnitude of the input electric current is supplied to the first pilot port 39*a* of the control valve 38 and the control valve 38 takes the first supply position 38*a*. Consequently, the hydraulic oil having a flow rate corresponding to the magnitude of the pilot pressure supplied to the first pilot port 39*a* is supplied to the first supply/discharge port 36*a* of the swing motor 36. In other words, the hydraulic oil having a flow rate corresponding to an operation amount to the right-swing position side of the lever 10*a* is supplied to the first supply/discharge port 36*a* of the swing motor 36. As a result, the swing motor 36 causes the upper swing body 7 to swing clockwise with a driving force corresponding to the operation amount of the lever 10*a*.

On the other hand, when the electric current is input to the left-swing switching valve 45, a pilot pressure corresponding to the magnitude of the input electric current is supplied to the second pilot port 39*b* of the control valve 38 and the control valve 38 takes the second supply position 38*b*. Consequently, the hydraulic oil having a flow rate corresponding to the magnitude of the pilot pressure supplied to the second pilot port 39*b* is supplied to the second supply/discharge port 36*b* of the swing motor 36. In other words, the hydraulic oil having a flow rate corresponding to an operation amount to the left-swing position side of the lever 10*a* is supplied to the second supply/discharge port 36*b* of the swing motor 36. As a result, the swing motor 36 causes the upper swing body 7 to swing counterclockwise with a driving force corresponding to the operation amount of the lever 10*a*.

When the overload calculating device 72 discriminates in step S3 that the state of the carrier 4 is the coupled state, subsequently, the main-body-side controller 82 discriminates whether the state of the carrier 4 is the grounded state or the afloat state (step S5). Specifically, when a detection signal output from the limit switch 70 of the afloat-state detecting section 56 is input to the main-body-side controller 82 via the carrier-side controller 84, the main-body-side controller 82 discriminates that the carrier 4 is in the afloat state. On the other hand, when the detection signal is not input, the main-body-side controller 82 discriminates that the carrier 4 is in the grounded state.

When discriminating that the carrier 4 is in the grounded state, subsequently, the main-body-side controller 82 calculates, on the basis of the second operation amount/current relation $F_{m2}$ (see FIG. 8), a current value corresponding to the operation amount from the neutral position of the lever 10*a* operated in step S2 and inputs an electric current equivalent to the derived current value to the switching valve, corresponding to the side where the lever 10*a* is operated, out of the right-swing switching valve 44 and the left-swing switching valve 45 (step S6). At this point, the electric current input to the switching valve is smaller than the electric current input to the switching valve from the main-body-side controller 82 in step S4. Therefore, a driving force with which the swing motor 36 causes the upper swing body 7 to swing in the next step S8 is smaller than the driving force with which the swing motor 36 causes the upper swing body 7 to swing according to the input of the electric current to the switching valve from the main-body-side controller 82 in step S4.

Specifically, a pilot pressure supplied to the pilot port 39*a* or 39*b* corresponding to the switching valve to which the electric current is input in step S6 is smaller than the pilot pressure supplied to the pilot port 39*a* or 39*b* corresponding to the switching valve to which the electric current is input in step S4. As a result, a flow rate of the hydraulic oil supplied to the swing motor 36 through the control valve 38 according to the input of the electric current to the switching valve in step S6 is smaller than the flow rate of the hydraulic oil supplied to the swing motor 36 through the control valve 38 according to the input of the electric current to the switching valve in step S4. Therefore, a driving force with which the swing motor 36 causes the upper swing body 7 to swing in step S8 after step S6 is smaller than the driving force with which the swing motor 36 causes the upper swing body 7 to swing in step S8 after step S4.

On the other hand, when determining in step S5 that the carrier 4 is in the afloat state, subsequently, the main-body-side controller 82 derives, on the basis of the third operation amount/current relation $F_{m3}$ (see FIG. 8), a current value corresponding to the operation amount from the neutral position of the lever 10*a* operated in step S2 and inputs an electric current equivalent to the derived current value to the switching valve, corresponding to a side where the lever 10*a* is operated, out of the right-swing switching valve 44 and the left-swing switching valve 45 (step S7). At this point, the electric current input to the switching valve is larger than the electric current input to the switching valve from the main-body-side controller 82 in step S6 and is smaller than the electric current input to the switching valve from the main-body-side controller 82 in step S4. Therefore, a driving force with which the swing motor 36 causes the upper swing body 7 to swing in step S8 after step S7 is larger than the driving force with which the swing motor 36 causes the upper swing body 7 to swing according to the input of the electric current to the switching valve from the main-body-side controller 82 in step S6 and is smaller than the driving force with which the swing motor 36 causes the upper swing body 7 to swing according to the input of the electric current to the switching valve from the main-body-side controller 82 in step S4.

Specifically, a pilot pressure supplied to the pilot port 39*a* or 39*b* corresponding to the switching valve to which the electric current is input in step S7 is larger than the pilot pressure supplied to the pilot port 39*a* or 39*b* corresponding to the switching valve to which the electric current is input in step S6 and is smaller than the pilot pressure supplied to the pilot port 39*a* or 39*b* corresponding to the switching valve to which the electric current is input in step S4. As a result, a flow rate of the hydraulic oil supplied to the swing motor 36 through the control valve 38 according to the input of the electric current to the switching valve in step S7 is larger than the flow rate of the hydraulic oil supplied to the swing motor 36 through the control valve 38 according to the input of the electric current to the switching valve in step S6 and is smaller than the flow rate of the hydraulic oil supplied to the swing motor 36 through the control valve 38 according to the input of the electric current to the switching valve in step S4. Therefore, a driving force with which the swing motor 36 causes the upper swing body 7 to swing in step S8 after step S7 is larger than the driving force with which the swing motor 36 causes the upper swing body 7 to swing in step S8 after step S6 and is smaller than the driving force with which the swing motor 36 causes the upper swing body 7 to swing in step S8 after step S4.

As explained above, the swing operation of the upper swing body 7 corresponding to the operation of the lever 10*a* is performed.

Figure 11:
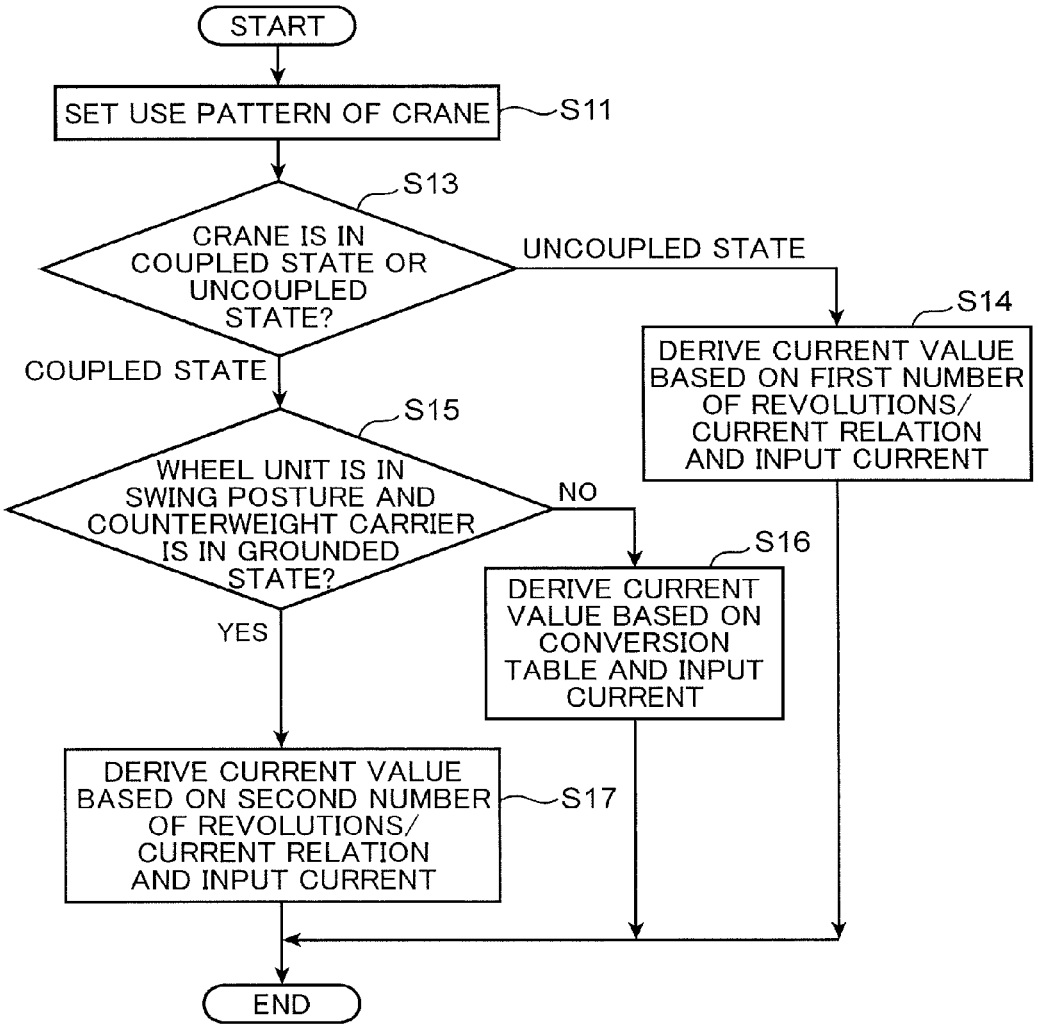
FIG. 11 is a flowchart for explaining a control process for a discharge flow rate of hydraulic oil of the hydraulic pump.

Control of the discharge flow rate of the hydraulic oil of the hydraulic pump 14 is performed in parallel to the flow rate control of the hydraulic oil by the control valve 38 for the swing operation of the upper swing body 7 explained above. A process of the control is shown in a flowchart of FIG. 11.

First, the operator performs setting of a use pattern of the crane 2 (step S11). Thereafter, the overload calculating device 72 discriminates whether the state of the crane 2 is the coupled state or the uncoupled state (step S13). The setting of the use pattern of the crane 2 in step S11 is a process common to step S1. Processing of the discrimination in step S13 is a process common to the processing in step S3.

When the overload calculating device 72 discriminates that the crane 2 is in the uncoupled state, subsequently, the main-body-side controller 82 derives, on the basis of the first number of revolutions/current relation $F_{r1}$ (see FIG. 9), a current value corresponding to the number of revolutions of the engine 12 detected by the number-of-revolutions detecting section 13 and inputs an electric current equivalent to the derived current value to the tilt-angle-adjustment proportional valve 15*b* (step S14). Consequently, the tilt-angle-adjustment proportional valve 15*b* adjusts a tilt angle of the swash plate 14*a* of the hydraulic pump 14 according to the magnitude of the input electric current and adjusts the displacement of the hydraulic pump 14. According to the adjustment, the tilt-angle-adjustment proportional valve 15*b* adjusts a discharge flow rate of the hydraulic oil of the hydraulic pump 14.

When the overload calculating device 72 discriminates in step S13 that the crane 2 is in the coupled state, subsequently, the main-body-side controller 82 discriminates whether the wheel unit 54 of the carrier 4 is in the swing posture and the carrier 4 is in the grounded state (step S15). At this point, when the carrier-side controller 84 causes the steering device 55 to steer the wheel unit 54 to the swing posture, the main-body-side controller 82 determines that the wheel unit 54 is in the swing posture. On the other hand, when the carrier-side controller 84 causes the steering device 55 to steer the wheel unit 54 to the traveling posture, the main-body-side controller 82 determines that the wheel unit 54 is not in the swing posture. When a detection signal generated by the limit switch 70 of the afloat-state detecting section 56 when detecting that the carrier 4 is afloat above the ground is input to the main-body-side controller 82 through the carrier-side controller 84, the main-body-side controller 82 determines that the carrier 4 is in the afloat state and is not in the grounded state. On the other hand, when the detection signal is not input to the main-body-side controller 82, the main-body-side controller 82 determines that the carrier 4 is in the grounded state.

When determining in step S15 that the wheel unit 54 is in the swing posture and the carrier 4 is in the grounded state, subsequently, the main-body-side controller 82 derives, on the basis of the second number of revolutions/current relation $F_{r2}$ (see FIG. 9), a current value corresponding to the number of revolutions of the engine 12 detected by the number-of-revolutions detecting section 13 and inputs an electric current equivalent to the derived current value to the tilt-angle-adjustment proportional valve 15*b* (step S17).

At this point, in a range of the number of revolutions of the engine 12 between the minimum number of revolutions $R_{min}$ and the predetermined number of revolutions $R_x$ (see FIG. 9), the electric current input to the tilt-angle-adjustment proportional valve 15*b* is smaller than the electric current input to the tilt-angle-adjustment proportional valve 15*b* in step S14. Consequently, in the range of the number of revolutions of the engine 12 between the minimum number of revolutions $R_{min}$ and the predetermined number of revolutions $R_x$, the discharge flow rate of the hydraulic oil of the hydraulic pump 14 is larger than the flow rate of the hydraulic oil discharged from the hydraulic pump 14 according to the input of the electric current to the tilt-angle-adjustment proportional valve 15*b* in step S14. In this way, when the number of revolutions of the engine 12 is near the minimum number of revolutions $R_{min}$, the discharge flow rate of the hydraulic oil of the hydraulic pump 14 is secured as a certain degree of a large flow rate. Therefore, even in a state in which moving speed (self-traveling speed) of the carrier 4 in the swing direction of the upper swing body 7 exceeds the swing speed of the upper swing body 7 generated by the driving of the swing motor 36 and the upper swing body 7 is pulled in the swing direction by the carrier 4 via the coupling beam 5 and swung, the swing motor 36 functions as a pump to suppress the hydraulic pump 14 side from having a negative pressure with respect to the swing motor 36 side. As a result, a backflow of the hydraulic oil from the swing motor 36 to the hydraulic pump 14 side is suppressed.

When determining in step S15 that the wheel unit 54 is not in the swing posture or determining in step S15 that the carrier 4 is not in the grounded state, subsequently, the main-body-side controller 82 derives, on the basis of the conversion table, a current value corresponding to the number of revolutions of the engine 12 detected by the number-of-revolutions detecting section 13 and inputs an electric current equivalent to the derived current value to the tilt-angle-adjustment proportional valve 15*b* (step S16). Consequently, the tilt-angle-adjustment proportional valve 15*b* adjusts the tilt angle of the swash plate 14*a* of the hydraulic pump 14 according to the magnitude of the input current and adjusts the displacement of the hydraulic pump 14. According to the adjustment of the tilt angle and the displacement, the tilt-angle-adjustment proportional valve 15*b* adjusts the discharge flow rate of the hydraulic oil of the hydraulic pump 14.

As explained above, the control of the discharge flow rate of the hydraulic oil of the hydraulic pump 14 is performed.

In this embodiment, when the carrier 4 is in the coupled state in which the carrier 4 is coupled to the upper swing body 7 and the carrier 4 is in the grounded state, compared with when the carrier 4 is in the uncoupled state in which the carrier 4 is disconnected from the upper swing body 7, a ratio of an increase in an input current to the switching valves 44 and 45 to an increase in an operation amount of the lever 10*a* is low. As a result, a supply flow rate of the hydraulic oil to the swing motor 36 adjusted by the control valve 38 decreases and power generated by the swing motor 36 for the swing of the upper swing body 7 decreases. That is, when the carrier 4 is in the coupled state and the grounded state, the power of the wheel driving motor 62 can be used for the swing of the upper swing body 7. Therefore, the power of the swing motor 36 decreases. Therefore, it is possible to prevent the power from becoming excessive.

In this embodiment, when the carrier 4 is in the coupled state in which the carrier 4 is coupled to the upper swing body 7 and the carrier 4 is in the afloat state, the ratio of the increase in the input current to the switching valves 44 and 45 to the increase in the operation amount of the lever 10*a* is higher than the ratio obtained when the carrier 4 is in the coupled state and the grounded state and is equal to or lower than the ratio obtained when the carrier 4 is in the uncoupled state. As a result, the supply flow rate of the hydraulic oil to the swing motor 36 adjusted by the control valve 38 is larger than the supply flow rate of the hydraulic oil to the swing motor 36 obtained when the carrier 4 is in the coupled state and the grounded state and is equal to or smaller than the supply flow rate of the hydraulic oil to the swing motor 36 obtained when the carrier 4 is in the uncoupled state. Consequently, the power generated by the swing motor 36 is larger than the power generated by the swing motor 36 when the carrier 4 is in the coupled state and the grounded state and is equal to or smaller than the power generated by the swing motor 36 when the carrier 4 is in the uncoupled state. When the carrier 4 is in the afloat state, the power of the wheel driving motor 62 cannot be used for the swing of the upper swing body 7. However, instead, since the power of the swing motor 36 increases, it is possible to suppress the swing speed of the upper swing body 7 from decreasing. Even if the power of the swing motor 36 in this case increases, the power is equal to or smaller than the power generated by the swing motor 36 when the carrier 4 is in the uncoupled state. Therefore, it is possible to prevent the power from becoming excessive.

As explained above, in this embodiment, it is possible to supply power appropriate for the swing of the upper swing body 7 according to presence or absence of the coupling of the carrier 4 to the upper swing body 7 and presence or absence of the grounding of the carrier 4 in a state in which the carrier 4 is coupled to the upper swing body 7.

In this embodiment, it is possible to prevent a hydraulic system around the hydraulic pump 14 of the crane main body 3 from being broken by a backflow of the hydraulic oil from the swing motor 36 side.

Specifically, when the carrier 4 is in the coupled state and the grounded state, the wheel unit 54 of the carrier 4 takes the swing posture, and the carrier 4 moves in the swing direction of the upper swing body 7 simultaneously with the swing of the upper swing body 7, in some case, the moving speed (the self-traveling speed) in the swing direction of the carrier 4 exceeds the swing speed of the upper swing body 7 generated by the driving of the swing motor 36 and the upper swing body 7 is pulled in the swing direction by the carrier 4 via the coupling beam 5 and swung. In this state, if the discharge flow rate of the hydraulic oil of the hydraulic pump 14 decreases to an extremely small flow rate when the number of revolutions of the engine 12 decreases to near a minimum number of revolutions as in the case of the uncoupled state of the carrier 4, in some case, the swing motor 36 functions as a pump and the hydraulic pump 14 side has a negative pressure with respect to the swing motor 36 side. In this case, the hydraulic oil sometimes flows back from the swing motor 36 to the hydraulic pump 14 side. As a result, the hydraulic system around the hydraulic pump 14 is likely to be broken. On the other hand, in this embodiment, when the carrier 4 is in the coupled state and the grounded state and the wheel unit 54 of the carrier 4 is in the swing posture, in a range of the number of revolutions of the engine 12 between the minimum number of revolutions and a predetermined number of revolutions higher than the minimum number of revolutions, the discharge flow rate of the hydraulic oil of the hydraulic pump 14 is a discharge flow rate larger than the discharge flow rate of the hydraulic oil of the hydraulic pump 14 obtained when the carrier 4 is in the uncoupled state. Therefore, even when the upper swing body 7 is pulled in the swing direction by the carrier 4 via the coupling beam 5 and swung as explained above, the swing motor 36 can function as the pump and suppress the hydraulic pump 14 side from having a negative pressure with respect to the swing motor 36 side. Therefore, it is possible to prevent the backflow of the hydraulic oil from the swing motor 36 to the hydraulic pump 14 side. As a result, it is possible to prevent breakage of the hydraulic system around the hydraulic pump 14 of the crane main body 3.

Note that it should be considered that the embodiment disclosed herein is illustrative and is not limitative in all aspects. The scope of the present invention is indicated by claims rather than the explanation of the embodiment and includes all changes within a meaning and a range equivalent to the claims.

For example, a pilot-pressure control device may be configured by a remote control valve provided in a supply route of a pilot pressure between a pilot pressure source and a pilot port of a control valve, a proportional solenoid decompression valve provided between the remote control valve and the pilot port of the control valve and configured to reduce the pilot pressure supplied to the pilot port of the control valve via the remote control valve, and a controller configured to control an electric current input to the proportional solenoid decompression valve according to operation of a swing operation lever to thereby control a degree of the decompression by the proportional solenoid decompression valve. In this case, according to an increase or a decrease in an operation amount of the swing operation lever, basically, the remote control valve controls the pilot pressure such that the pilot pressure supplied to the pilot port of the control valve increases or decreases. However, the controller only has to control the degree of the decompression by the proportional solenoid decompression valve to thereby generate, according to the increase in the operation amount of the swing operation lever, a state in which the pilot pressure increases at the first ratio, a state in which the pilot pressure increases at the second ratio, and a state in which the pilot pressure increases at the third ratio.

In the embodiment, the overload calculating device discriminates, on the basis of both whether the derived load value of the hoisting ability of the crane is equal to or larger than the reference value and whether the connection signal is input to the main-body-side controller from the carrier-side controller, whether the state concerning the carrier of the crane is the coupled state or the uncoupled state. However, a discrimination method for the state concerning the carrier of the crane is not necessarily limited to the discrimination method in the embodiment. For example, the overload calculating device may discriminate, on the basis of only whether the derived load value of the hoisting ability of the crane is equal to or larger than the reference value, whether the state concerning the carrier of the crane is the coupled state or the uncoupled state. The overload calculating device may discriminate, on the basis of only whether the connection signal is input to the main-body-side controller from the carrier-side controller, whether the state concerning the carrier of the crane is the coupled state or the uncoupled state.

Overview of the Embodiment

The embodiment is summarized as explained below.

A mobile crane according to the embodiment includes: a crane main body including a lower traveling body capable of self-traveling and an upper swing body mounted on the lower traveling body to be capable of swinging around a vertical axis, the upper swing body including a work device adapted to perform hoisting work; a counterweight carrier configured to be capable of being switched to a coupled state in which the counterweight carrier is coupled to the upper swing body and an uncoupled state in which the counterweight carrier is disconnected from the upper swing body, in the coupled state, the counterweight carrier being movable according to a movement of the crane main body in a state in which a counterweight is mounted on the counterweight carrier and being capable of taking a grounded state and an afloat state, the grounded state being a state in which the counterweight carrier is in contact with a ground, the afloat state being a state in which the counterweight carrier is afloat above the ground with a load transmitted from the work device; a coupled-state deriving section configured to derive a state taken by the counterweight carrier out of the coupled state and the uncoupled state; and an afloat-state detecting section configured to detect a state taken by the counterweight carrier out of the grounded state and the afloat state. The crane main body includes: an operation section configured to be operated to instruct an operation of the crane main body; a hydraulic pump configured to discharge hydraulic oil; a main-body driving motor configured to generate power for causing the crane main body to operate by being supplied with the hydraulic oil discharged from the hydraulic pump; a control valve provided in a supply route of the hydraulic oil between the hydraulic pump and the main-body driving motor and configured to control a supply flow rate of the hydraulic oil such that the supply flow rate of the hydraulic oil to the main-body driving motor increases as a pilot pressure supplied to the control valve increases; a pilot pressure source configured to supply the pilot pressure to the control valve; and a pilot-pressure control device configured to control the pilot pressure supplied from the pilot pressure source to the control valve. The counterweight carrier includes a carrier driving motor configured to generate power for moving the counterweight carrier according to a movement of the crane main body. The pilot-pressure control device is configured to increase the pilot pressure supplied to the control valve at a first ratio according to an increase in an operation amount of the operation section when the state derived by the coupled-state deriving section is the uncoupled state, increase the pilot pressure supplied to the control valve at a second ratio lower than the first ratio according to the increase in the operation amount of the operation section when the state derived by the coupled-state deriving section is the coupled state and the state detected by the afloat-state detecting section is the grounded state, and increase the pilot pressure supplied to the control valve at a third ratio higher than the second ratio and equal to or lower than the first ratio according to the increase in the operation amount of the operation section when the state derived by the coupled-state deriving section is the coupled state and the state detected by the afloat-state detecting section is the afloat state.

In the crane, when the counterweight carrier is in the coupled state in which the counterweight carrier is coupled to the upper swing body and the counterweight carrier is in the grounded state, compared with when the counterweight carrier is in the uncoupled state in which the counterweight carrier is disconnected from the upper swing body, a ratio of the increase in the pilot pressure to the increase in the operation amount of the operation section is low. As a result, a supply flow rate of the hydraulic oil to the main-body driving motor adjusted by the control valve, to which the pilot pressure is supplied, decreases. The power generated by the main-body driving motor for the operation of the crane main body decreases. When the counterweight carrier is in the coupled state and the grounded state, since the power of the carrier driving motor can be used for the operation of the crane main body, the power of the main-body driving motor decreases. Therefore, it is possible to prevent the power from becoming excessive. When the counterweight carrier is in the coupled state in which the counterweight carrier is coupled to the upper swing body and the counterweight is in the afloat state, the ratio of the increase in the pilot pressure to the increase in the operation amount of the operation section is higher than the ratio obtained when the counterweight carrier is in the coupled state and the grounded state and is equal to or lower than the ratio obtained when the counterweight carrier is in the uncoupled state. Consequently, the supply flow rate of the hydraulic oil to the main-body driving motor adjusted by the control valve is larger than the supply flow rate of the hydraulic oil to the main-body driving motor obtained when the counterweight carrier is in the coupled state and the grounded state and is equal to or smaller than the supply flow rate of the hydraulic oil to the main-body driving motor obtained when the counterweight carrier is in the uncoupled state. As a result, the power generated by the main-body driving motor for the operation of the crane main body is larger than the power generated by the main-body driving motor when the counterweight carrier is in the coupled state and the grounded state and is equal to or smaller than the power generated by the main-body driving motor when the counterweight carrier is in the uncoupled state. When the counterweight carrier is in the afloat state, the power of the carrier driving motor cannot be used for the operation of the crane main body. However, instead, since the power of the main-body driving motor increases, it is possible to suppress the operation speed of the crane main body from decreasing. Even if the power of the main-body driving motor increases, since the power is equal to or smaller than the power generated by the main-body driving motor when the counterweight carrier is in the uncoupled state, it is possible to prevent the power from becoming excessive. As explained above, in the crane, it is possible to supply power appropriate for the operation of the crane main body according to presence or absence of coupling of the counterweight carrier to the upper swing body and presence or absence of grounding of the counterweight carrier in the state in which the counterweight carrier is coupled to the upper swing body.

In the mobile crane, the pilot-pressure control device may include: a proportional solenoid valve provided in a supply route of the pilot pressure between the pilot pressure source and the control valve and configured to adjust the pilot pressure such that the pilot pressure supplied to the control valve increases as an input electric current increases; and a controller configured to control the electric current input to the proportional solenoid valve according to operation of the operation section to thereby control the proportional solenoid valve. The controller may be configured to increase the electric current input to the proportional solenoid valve at the first ratio according to the increase in the operation amount of the operation section when the state derived by the coupled-state deriving section is the uncoupled state, increase the electric current input to the proportional solenoid valve at the second ratio according to the increase in the operation amount of the operation section when the state derived by the coupled-state deriving section is the coupled state and the state detected by the afloat-state detecting section is the grounded state, and increase the electric current input to the proportional solenoid valve at the third ratio according to the increase in the operation amount of the operation section when the state derived by the coupled-state deriving section is the coupled state and the state detected by the afloat-state detecting section is the afloat state.

With this configuration, it is possible to embody the pilot-pressure control device in the mobile crane.

In this case, it is preferable that the counterweight carrier includes wheels rotated by the carrier driving motor during the movement of the counterweight carrier, the wheels are configured to be capable of being steered to take a traveling posture in which the wheels face a traveling direction of the lower traveling body during traveling of the crane main body by the lower traveling body and take a swing posture in which the wheels face a direction along a swing direction of the upper swing body during swinging of the upper swing body, the hydraulic pump is a variable displacement pump capable of changing a discharge flow rate of the hydraulic oil discharged by the hydraulic pump, the crane main body includes: an engine configured to cause the hydraulic pump to operate; and a discharge-flow-rate changing device configured to cause the hydraulic pump to change the discharge flow rate of the hydraulic oil, and when the state derived by the coupled-state deriving section is the uncoupled state, the controller causes the discharge-flow-rate changing device to change the discharge flow rate of the hydraulic oil of the hydraulic pump such that the discharge flow rate of the hydraulic oil of the hydraulic pump increases as the number of revolutions of the engine increases from a minimum number of revolutions, and, when the state derived by the coupled-state deriving section is the coupled state, the state detected by the afloat-state detecting section is the grounded state, and the wheels of the counterweight carrier is in the swing posture, the controller causes the discharge-flow-rate changing device to set the discharge flow rate of the hydraulic oil of the hydraulic pump such that, in a range of the number of revolutions of the engine between the minimum number of revolutions and a predetermined number of revolutions higher than the minimum number of revolutions, the discharge flow rate of the hydraulic oil of the hydraulic pump is larger than the discharge flow rate of the hydraulic oil of the hydraulic pump obtained when the state derived by the coupled-state deriving section is the uncoupled state.

With this configuration, it is possible to prevent a hydraulic system around the hydraulic pump of the crane main body from being broken by a backflow of the hydraulic oil from the main-body driving motor side. Specifically, when the counterweight carrier is in the coupled state and the grounded state, the wheels of the counterweight carrier takes the swing posture, and the counterweight carrier moves in the swing direction of the upper swing body simultaneously with the swing of the upper swing body, in some case, the moving speed in the swing direction of the counterweight carrier exceeds the swing speed of the upper swing body generated by the driving of the main-body driving motor and the upper swing body is pulled by the counterweight carrier moving in the swing direction and swung. In this state, if the discharge flow rate of the hydraulic oil of the hydraulic pump decreases to an extremely small flow rate when the number of revolutions of the engine decreases to near a minimum number of revolutions as in the case of the uncoupled state of the counterweight carrier, in some case, the main-body driving motor functions as a pump and the hydraulic pump side has a negative pressure with respect to the main-body driving motor side. In this case, the hydraulic oil sometimes flows back from the main-body driving motor to the hydraulic pump side. As a result, the hydraulic system around the hydraulic pump is likely to be broken. On the other hand, in this configuration, when the counterweight carrier is in the coupled state and the grounded state and the wheels of the counterweight carrier is in the swing posture, in a range of the number of revolutions of the engine between the minimum number of revolutions and a predetermined number of revolutions higher than the minimum number of revolutions, the discharge flow rate of the hydraulic oil of the hydraulic pump is a discharge flow rate larger than the discharge flow rate of the hydraulic oil of the hydraulic pump obtained when the counterweight carrier is in the uncoupled state. Therefore, even when the upper swing body is pulled in the swing direction by the counterweight carrier and swung as explained above, the main-body driving motor can function as the pump and suppress the hydraulic pump side from having a negative pressure with respect to the main-body driving motor side. Therefore, it is possible to prevent the backflow of the hydraulic oil from the main-body driving motor to the hydraulic pump side. As a result, it is possible to prevent breakage of the hydraulic system around the hydraulic pump of the crane main body.

As explained above, according to the embodiment, it is possible to provide a mobile crane capable of supplying power appropriate for operation of a crane main body according to presence or absence of coupling of a counterweight carrier to an upper swing body and presence or absence of grounding of the counterweight carrier in a state in which the counterweight carrier is coupled to the upper swing body.

This application is based on Japanese Patent application No. 2015-145698 filed in Japan Patent Office on Jul. 23, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A mobile crane comprising:

a crane main body including a lower traveling body capable of self-traveling and an upper swing body mounted on the lower traveling body to be capable of swinging around a vertical axis, the upper swing body including a work device adapted to perform hoisting work;

a counterweight carrier configured to be capable of being switched to a coupled state in which the counterweight carrier is coupled to the upper swing body and an uncoupled state in which the counterweight carrier is disconnected from the upper swing body, in the coupled state, the counterweight carrier being movable according to a movement of the crane main body in a state in which a counterweight is mounted on the counterweight carrier and being capable of taking a grounded state and an afloat state, the grounded state being a state in which the counterweight carrier is in contact with a ground, the afloat state being a state in which the counterweight carrier is afloat above the ground with a load transmitted from the work device;

a coupled-state deriving section configured to derive a state taken by the counterweight carrier out of the coupled state and the uncoupled state; and an afloat-state detecting section configured to detect a state taken by the counterweight carrier out of the grounded state and the afloat state, wherein the crane main body includes:

an operation section configured to be operated to instruct an operation of the crane main body;

a hydraulic pump configured to discharge hydraulic oil;

a main-body driving motor configured to generate power for causing the crane main body to operate by being supplied with the hydraulic oil discharged from the hydraulic pump;

a control valve provided in a supply route of the hydraulic oil between the hydraulic pump and the main-body driving motor and configured to control a supply flow rate of the hydraulic oil such that the supply flow rate of the hydraulic oil to the main-body driving motor increases as a pilot pressure supplied to the control valve increases;

a pilot pressure source configured to supply the pilot pressure to the control valve; and a pilot-pressure control device configured to control the pilot pressure supplied from the pilot pressure source to the control valve, the counterweight carrier includes a carrier driving motor configured to generate power for moving the counterweight carrier according to a movement of the crane main body, and the pilot-pressure control device is configured to increase the pilot pressure supplied to the control valve at a first ratio according to an increase in an operation amount of the operation section when the state derived by the coupled-state deriving section is the uncoupled state, increase the pilot pressure supplied to the control valve at a second ratio lower than the first ratio according to the increase in the operation amount of the operation section when the state derived by the coupled-state deriving section is the coupled state and the state detected by the afloat-state detecting section is the grounded state, and increase the pilot pressure supplied to the control valve at a third ratio higher than the second ratio and equal to or lower than the first ratio according to the increase in the operation amount of the operation section when the state derived by the coupled-state deriving section is the coupled state and the state detected by the afloat-state detecting section is the afloat state.

2. The mobile crane according to claim 1, wherein the pilot-pressure control device includes:

a proportional solenoid valve provided in a supply route of the pilot pressure between the pilot pressure source and the control valve and configured to adjust the pilot pressure such that the pilot pressure supplied to the control valve increases as an input electric current increases; and a controller configured to control the electric current input to the proportional solenoid valve according to operation of the operation section to thereby control the proportional solenoid valve, and the controller is configured to increase the electric current input to the proportional solenoid valve at the first ratio according to the increase in the operation amount of the operation section when the state derived by the coupled-state deriving section is the uncoupled state, increase the electric current input to the proportional solenoid valve at the second ratio according to the increase in the operation amount of the operation section when the state derived by the coupled-state deriving section is the coupled state and the state detected by the afloat-state detecting section is the grounded state, and increase the electric current input to the proportional solenoid valve at the third ratio according to the increase in the operation amount of the operation section when the state derived by the coupled-state deriving section is the coupled state and the state detected by the afloat-state detecting section is the afloat state.

3. The mobile crane according to claim 2, wherein the counterweight carrier includes wheels rotated by the carrier driving motor during the movement of the counterweight carrier, the wheels are configured to be capable of being steered to take a traveling posture in which the wheels face a traveling direction of the lower traveling body during traveling of the crane main body by the lower traveling body and take a swing posture in which the wheels face a direction along a swing direction of the upper swing body during swinging of the upper swing body, the hydraulic pump is a variable displacement pump capable of changing a discharge flow rate of the hydraulic oil discharged by the hydraulic pump, the crane main body includes:

an engine configured to cause the hydraulic pump to operate; and a discharge-flow-rate changing device configured to cause the hydraulic pump to change the discharge flow rate of the hydraulic oil, and when the state derived by the coupled-state deriving section is the uncoupled state, the controller causes the discharge-flow-rate changing device to change the discharge flow rate of the hydraulic oil of the hydraulic pump such that the discharge flow rate of the hydraulic oil of the hydraulic pump increases as the number of revolutions of the engine increases from a minimum number of revolutions, and, when the state derived by the coupled-state deriving section is the coupled state, the state detected by the afloat-state detecting section is the grounded state, and the wheels of the counterweight carrier is in the swing posture, the controller causes the discharge-flow-rate changing device to set the discharge flow rate of the hydraulic oil of the hydraulic pump such that, in a range of the number of revolutions of the engine between the minimum number of revolutions and a predetermined number of revolutions higher than the minimum number of revolutions, the discharge flow rate of the hydraulic oil of the hydraulic pump is larger than the discharge flow rate of the hydraulic oil of the hydraulic pump obtained when the state derived by the coupled-state deriving section is the uncoupled state.

* * * * *